US010607525B2

(12) United States Patent
Akhavan et al.

(10) Patent No.: US 10,607,525 B2
(45) Date of Patent: Mar. 31, 2020

(54) SYSTEM AND METHOD FOR COLOR RETARGETING

(71) Applicant: IRYSTEC SOFTWARE, INC., Montréal (Québec) (CA)

(72) Inventors: Tara Akhavan, Montréal (CA); Mehdi Rezagholizadeh, Montréal (CA); Afsoon Soudi, Montréal (CA)

(73) Assignee: Irystec Software Inc., Montreal Quebec (CA)

( * ) Notice: Subject to any disclaimer, the term of this patent is extended or adjusted under 35 U.S.C. 154(b) by 89 days.

(21) Appl. No.: 15/575,562

(22) PCT Filed: May 19, 2016

(86) PCT No.: PCT/CA2016/050565
§ 371 (c)(1),
(2) Date: Nov. 20, 2017

(87) PCT Pub. No.: WO2016/183681
PCT Pub. Date: Nov. 24, 2016

(65) Prior Publication Data

US 2018/0130393 A1 May 10, 2018

Related U.S. Application Data

(60) Provisional application No. 62/163,516, filed on May 19, 2015.

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2320/066* (2013.01);
(Continued)

(58) Field of Classification Search
CPC ..... G09G 3/2003; G09G 2320/0626; G09G 2340/06; G09G 3/3208
See application file for complete search history.

(56) References Cited

U.S. PATENT DOCUMENTS 6,028,646 A * 2/2000 Jeong ..... H04N 9/646 348/34
6,894,720 B2 5/2005 Zhang
(Continued)

FOREIGN PATENT DOCUMENTS

EP 2992405 A1 3/2016
EP 3026908 A1 6/2016
(Continued)

OTHER PUBLICATIONS

Anne-Marie Chang, Daniel Aeschbach, Jeanne F. Duffy and Charles A. Czeisler, "Evening use of light-emitting eReaders negatively affects sleep, circadian timing, and next-morning alertness", PNAS, Jan. 27, 2015, vol. 112, No. 4, pp. 1232-1237.
(Continued)

*Primary Examiner* — Nelson M Rosario
(74) *Attorney, Agent, or Firm* — Occhiuti & Rohlicek LLP

(57) ABSTRACT

A system and method for color retargeting of an image includes applying a color appearance model to the image to be displayed based in part on a first luminance level. The color appearance model outputs a first set of color responses representing a simulated version of the image at the first luminance level. A color compensation model is further applied to the first set of color responses based in part on a second luminance level. The color compensation model outputs a second set of color responses representing a compensated version of the image. The compensated version of the image may be displayed on a display device set
(Continued)

at the second luminance level. At least one of the color appearance model and the color compensation model applies rod-intrusion correction.

28 Claims, 17 Drawing Sheets
(15 of 17 Drawing Sheet(s) Filed in Color)

(52) U.S. Cl.
CPC ..... *G09G 2320/0606* (2013.01); *G09G 2320/0626* (2013.01); *G09G 2320/0666* (2013.01); *G09G 2340/06* (2013.01)

(56) References Cited

U.S. PATENT DOCUMENTS

| | | | |
|---|---|---|---|
| 7,136,073 | B2 | 11/2006 | Newman |
| 7,492,375 | B2 | 2/2009 | Toyama et al. |
| 8,160,387 | B2 | 4/2012 | Chesnokov |
| 8,330,768 | B2 | 12/2012 | Mantiuk et al. |
| 8,339,475 | B2 | 12/2012 | Atanassov et al. |
| 8,363,131 | B2 | 1/2013 | Lin |
| 8,391,598 | B2 | 3/2013 | Lin |
| 8,456,327 | B2 | 6/2013 | Bechtel et al. |
| 8,463,034 | B2 | 6/2013 | Sambongi et al. |
| 8,483,479 | B2 | 7/2013 | Kunkel et al. |
| 8,831,343 | B2 | 9/2014 | Kunkel et al. |
| 8,907,971 | B2 | 12/2014 | Ballestad et al. |
| 9,092,878 | B2 | 7/2015 | Spitzer et al. |
| 9,299,167 | B2 | 3/2016 | Wan et al. |
| 9,384,561 | B2 | 7/2016 | Romanenko |
| 9,489,920 | B2 | 11/2016 | Tusch |
| 9,747,674 | B2 | 8/2017 | Boitard et al. |
| 9,842,385 | B2 | 12/2017 | Atkins |
| 9,858,677 | B2 | 1/2018 | Romanenko |
| 2006/0002611 | A1 | 1/2006 | Mantiuk et al. |
| 2010/0172411 | A1 | 7/2010 | Efremov et al. |
| 2011/0175925 | A1 | 7/2011 | Kane et al. |
| 2012/0218282 | A1 | 8/2012 | Choboter et al. |
| 2013/0322532 | A1 | 12/2013 | Efremov et al. |
| 2016/0026245 | A1 | 1/2016 | Mantiuk et al. |

FOREIGN PATENT DOCUMENTS

| | | | |
|---|---|---|---|
| PL | 403689 | A1 | 10/2014 |
| WO | 2015189629 | A2 | 12/2015 |

OTHER PUBLICATIONS

Adam G. Kirk, James F. O'Brien, "Perptually Based Tone Mapping for Low-Light Conditions", ACM Transactions on Graphics, Jul. 2011, vol. 30, No. 4, Article 42, pp. 42:1 to 42:9.

Belen Masia, Gordon Wetzstein, Piotr Didyk, Diego Gutierrez, "A survey on computational displays: Pushing the boundaries of optics, computation, and perception", Computer & Graphics, 2013, vol. 37, pp. 1012-1038.

Brian A. Wandell and E.J. Chichilnisky, "Color Appearance in Images Measurements and Musings", IS&T and SID's 2nd Color Imaging Conference: Color Science, Systems and Applications, 1994, pp. 1-4.

Andrew J. Zele and Dingcai Cao, "Vision under mesopic and scotopic illumination", Frontiers in Psychology, Jan. 2015, vol. 5, Article 1594, pp. 1-15.

Dingcai Cao, Joel Pokorny, Vivianne C. Smith, Andrew J. Zele, "Rod contributions to color perception: Linear with rod contrast", Vision Research, 2008, vol. 48, pp. 2586-2592.

Donghwa Shin, Younghyun Kim, Massoud Pedram and Naehyuck Chang, "Dynamic Voltage Scaling of OLED Displays", DAC'II, Jun. 5-10, 2011, San Diego, California, USA, Copyright 2011, pp. 53-58.

Mark D. Fairchild, "A Revision of CIECAM97s for Practical Applications", John Wiley & Sons, Inc., Dec. 2001, vol. 26, No. 6, pp. 418-427.

M.D. Fairchild, "Color Appearance Phenomena", Color appearance Models, 2nd Edition, pp. 125.

James A. Ferwerda, Sumanta N. Pattanaik, Peter Shirley and Donald P. Greenberg, "A Model of Visual Adaptation for Realistic Image Synthesis", Program of Cumputer Graphics, Cornell University, USA, pp. 249-258, http//www.graphics.cornell.edu.

Gabriel Eilertsen, Robert Wanat, Rafal K. Mantiuk and Jonas Unger, "Evaluation of Tone Mapping Operators for HDR-Video", The Eurographics Association and John Wiley & Sons Ltd., Computer Graphic Forum, 2013, vol. 32, No. 7, 10 pages.

Greg Ward, "High Dynamic Range Imaging", Exponent—Failure Analysis Association, Menlo Park, California, 8 pages.

Jiangtao Kuang, Garrett M. Johnson, Mark D. Fairchild, "iCAM06: A refined image appearance model for HDR image rendering", Journal of Visual Communication & Image Representation, ScienceDirect, 2007, vol. 18, pp. 406-414.

John J. McCann, "Color gamuts in dim illuminattion", Conference Proceedings of SPIE, SPIE vol. 6807, Electronic Imaging, 2008, San Jose, California, USA, 10 pages, SPIEDigitalLibrary.org/conference-proceedings-of-spie.

Janne S. Laine, "Adapting softcopy color reproduction to ambient illumination", Journal of the SID, 2003, vol. 11, No. 2, pp. 359-369.

JaeChul Shin, Naoki Matsuki, Hirohisa Yaguchi and Satoshi Shioiri, "A Color Appearance Model Applicable in Mesopic Vision", The Optical Society of Japan, Optical Review, 2004, vol. 11, No. 4, pp. 272-278.

James J. Clark and Sandra Skaff, "A spectral theory of color perception", Journal Optical Society of America, Dec. 2009, vol. 26, No. 12, pp. 2488-2502.

Karlheinz Blankenbach, Andrej Sycev, Sascha Kurbatfinski, Martin Zobl, "Optimizing and evaluating new automotive HMI image enhancement algorithms under bright light conditions using display reflectance characteristics", Journal of Society Information Display, (2015) vol. 22, No. 5, pp. 267-279.

Mehdi Rezagholizadeh, James J. Clark, "Photon Detection and Color Perception at Low Light Levels", Canadian Conference on Computer and Robot Vision, 2014, pp. 283-290.

Mark Fairchild, Garrett Johnson, "Image appearance modeling", Rochester Institute of Technology, RIT Scholar Works, Presentations and other scholarship, 2003, 13 pages, http://scholarworks.rit.edu/other.

Mark D. Fairchild and Garrett M. Johnson, "Meet iCAM': A Next-Generation Color Appearance Model", Rochester Institute of Technology, Rochester, NY, 7 pages.

Michael F. Deering, "A Photon Accurate Model of the Human Eye", SIGGRAPH 2005, pp. 1-10.

Mehdi Rezagholizadeh, James J. Clark, "Maximum Entropy Spectral Modeling Approach to Mesopic Tone Mapping", Center for Intelligent Machines, McGill University, Montreal, Quebec, Canada, 6 pages.

Min H. Kim, Tim Weyrich, Jan Kautz, "Modeling Human Color Perception under Extended Luminance Levels", ACM Transactions on Graphics, 2009, vol. 28, No. 3, Article 27, pp. 27:1 to 27:9.

Petr Kellnhofer, Tobias Ritschel, Karol Myszkowski, Elmar Eisemann, Hans-Peter Seidel, "Modeling Luminance Perception at Absolute Threshold", Eurographics Symposium on Rendering, 2015, vol. 34, No. 4, 10 pages.

Robert Wanat, Rafal K. Mantiuk, "A comparision of night vision simulation methods for video", CVMP'14, Nov. 2014, London, United Kingdom, 8 pages, http://play0ad.com/.

Robert Wanat, Rafal K. Mantiuk, "Simulating and compensating changes in appearance between day and night vision", ACM Transactions on Graphics, Jul. 2014, vol. 33, No. 4, Article 147, pp. 147:1 to 147:12.

R. W. G. Hunt, "An Improved Predictor of Colourfulness in a Model of Colour Vision", John Wiley & Sons, Inc., Color Research and Application, Feb. 1994, vol. 19, No. 1, pp. 23-26.

Saad Masood Khan, Sumanta N. Pattanaik, "Modeling Blue shift in Moonlit Scenes by Rod Cone Interaction", University of Central Florida, Paper ID: 0151, 5 pages.

(56) References Cited

OTHER PUBLICATIONS

William B. Thompson, Peter Shirley and James A. Ferwerda, "A Spatial Post-Processing Algorithm for Images of Night Scenes", Journal of Graphics Tools, Dec. 2017, vol. 7, No. 1, pp. 01-12.
Youngshin Kwak, Lindsay William MacDonald, M. Ronnier Luo, "Proceedings of SPIE—Mesopic color appearance", Human Vision and Electronic Imaging VIII, SPIE-IS&T Electronic Imaging SPIE vol. 5007, 2003, SPIEDigitalLibrary.org/conference-proceedings-of-spie.
Youngshin Kwak, Lindsay W. MacDonald and M. Ronnier Luo, "Prediction of Lightness in Mesopic Vision", IS&T Eleventh Color Imaging Conference, pp. 301-307.
M.D. Fairchild, "Color Appearance Models", 3rd Edition, John Willey & Sons, Inc., pp. 81-83.
International Search Report and Written Opinion for PCT/CA2016/050565, dated Aug. 2, 2016, 9 pages.

* cited by examiner

SYSTEM AND METHOD FOR COLOR RETARGETING

RELATED PATENT APPLICATION

The present application is a National Stage of International Application No. PCT/CA2016/050565 filed on May 19, 2016, which claims priority from U.S. provisional patent application No. 62/163,516, filed May 19, 2015 and entitled "SYSTEM AND METHOD FOR COLOR RETARGETING", the disclosure of which is hereby incorporated by reference in its entirety.

TECHNICAL FIELD

The technical field generally relates to systems and methods for color retargeting, and more particularly, for applying to an image a color appearance model followed by a color compensation model.

BACKGROUND

With emerging technologies such as quantum dots and organic light emitting diodes (OLEDs), display technology has been advancing quickly, giving users a broader color perception experience. OLED displays have a bigger gamut area compared to the conventional CRT and LCD displays, therefore they have great potential for high quality images with low power consumption [1]. Due to their emissive pixel structure, OLED displays exert high contrast ratio, high and constant color gamut at all gray levels.

In today's world, every individual spends a great deal of time in front of displays in various applications such as consumer electronic devices (e.g., smart phones, tablets and laptops), the automotive industry,[2] and virtual reality interfaces (e.g., head-mounted displays). Working with bright displays raises power consumption and eye strain issues which affect user satisfaction. For example, it has shown that using e-Readers with backlighting interferes with the human circadian rhythm [3]. Moreover, watching TV or any bright display in dark conditions brings about negative impacts such as eye strain and reduces the lifetime of the display.

Furthermore, with increasing demand and use of portable electronic devices (such as smart phones, tablets and laptops) for video streaming in controlled environments, power consumption and eye-fatigue become extremely important, affecting the customer satisfaction and therefore device manufacturing.

Typically, an important objective in the display manufacturing industry is to create more natural images for human viewers. To achieve this goal, visual system mechanisms such as contrast, luminance and color perception need to be taken into account in display rendering units.

SUMMARY

According to one aspect, therein is provided a computer-implemented color system for color retargeting of an image. The system includes at least one data storage device and at least one processor coupled to the at least one storage device. the at least one processor being configured for applying a color appearance model to the image to be displayed based in part on a first luminance level, the color appearance model outputting a first set of color responses representing a simulated version of the image at the first luminance level; and applying a color compensation model to the first set of color responses based in part on a second luminance level, the color compensation model outputting a second set of color responses representing a compensated version of the image. At least one of the color appearance model and the color compensation model applying rod-intrusion correction.

According to another aspect, there is provided a method for color retargeting of an image. The method includes applying a color appearance model to the image to be displayed based in part on a first luminance level, the color appearance model outputting a first set of color responses representing a simulated version of the image at the first luminance level and applying a color compensation model to the first set of color responses based in part on a second luminance level, the color compensation model outputting a second set of color responses representing a compensated version of the image, at least one of the color appearance model and the color compensation model applying rod-intrusion correction.

According to yet another aspect, there is provided a computer readable storage medium comprising computer executable instructions for color retargeting of an image, the computer executable instructions have instructions for performing the methods described herein.

According to yet another aspect, therein is provided a method of processing images. The method includes obtaining an image, applying Shin's model to the image to generate a set of luminance dependent parameters based at least in part on scene luminance associated with the image, applying an inverse of Shin's model to the luminance dependent parameters to approximate white point LMS values based at least in part on display luminance associated with a display onto which the image is to be shown, transforming the LMS values to generate a target image and outputting the target image for display.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
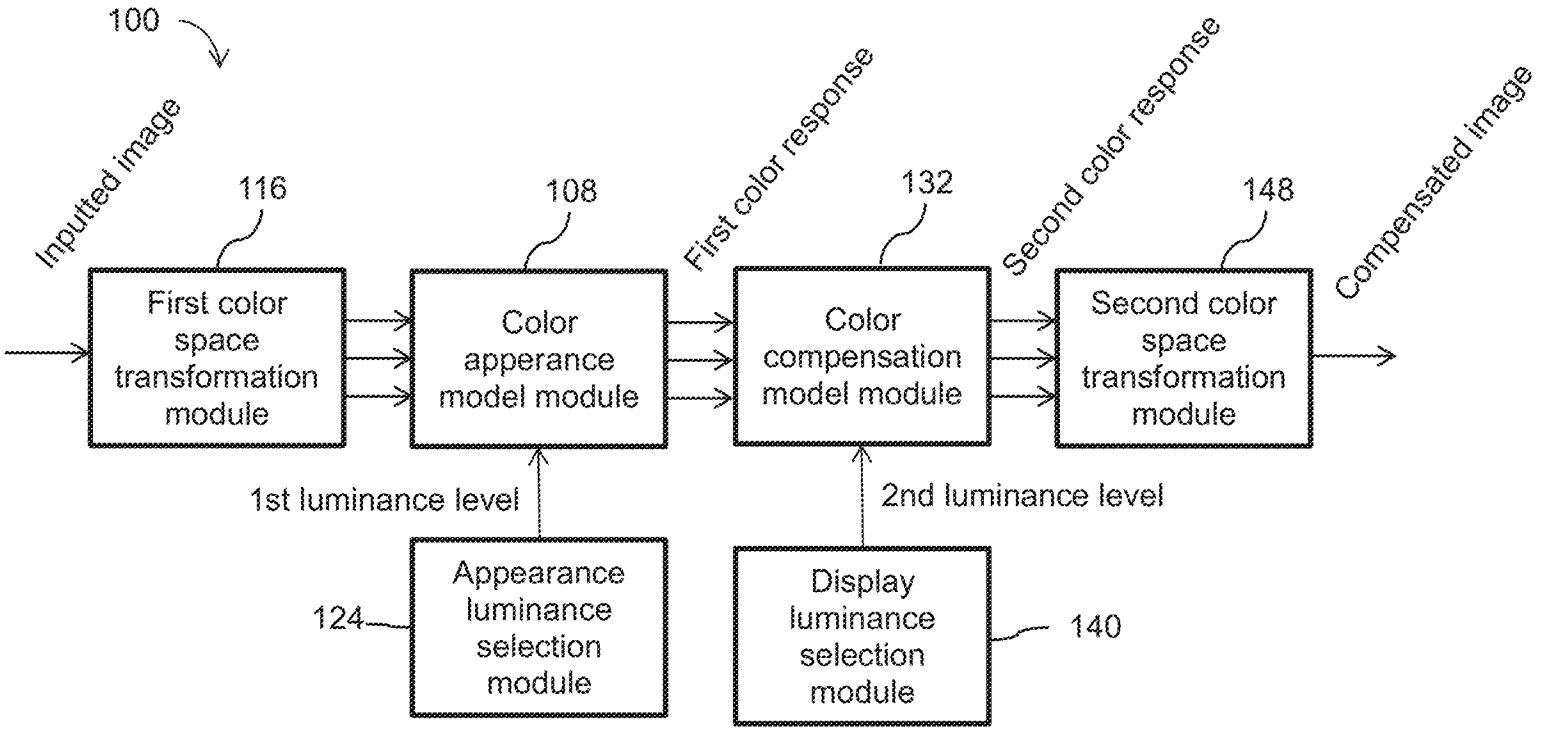
FIG. 1 illustrates a schematic diagram of the operational modules of a color retargeting system according to one example embodiment.

One or more systems described herein may be implemented in computer programs executing on programmable computers, each comprising at least one processor, a data storage system (including volatile and non-volatile memory and/or storage elements), at least one input device, and at least one output device. For example, and without limitation, the programmable computer may be a programmable logic unit, a mainframe computer, server, and personal computer, cloud based program or system, laptop, personal data assistance, cellular telephone, smartphone, wearable device, tablet device, virtual reality devices, smart display devices (ex: Smart TVs), video game console, or portable video game devices.

Each program is preferably implemented in a high level procedural or object oriented programming and/or scripting language to communicate with a computer system. However, the programs can be implemented in assembly or machine language, if desired. In any case, the language may be a compiled or interpreted language. Each such computer program is preferably stored on a storage media or a device readable by a general or special purpose programmable computer for configuring and operating the computer when the storage media or device is read by the computer to perform the procedures described herein. In some embodiments, the systems may be embedded within an operating system running on the programmable computer. In other example embodiments, the system may be implemented in hardware, such as within a video card.

Furthermore, the systems, processes and methods of the described embodiments are capable of being distributed in a computer program product comprising a computer readable medium that bears computer-usable instructions for one or more processors. The medium may be provided in various forms including one or more diskettes, compact disks, tapes, chips, wireline transmissions, satellite transmissions, internet transmission or downloadings, magnetic and electronic storage media, digital and analog signals, and the like. The computer-usable instructions may also be in various forms including compiled and non-compiled code.

It has been observed that displays are a main consumer of battery power in portable electronic devices. Any display device performing at a high level of brightness reduces the lifetime of the display. Moreover, high brightness creates eye strain. Dimming the display provides an initial solution to both issues, however, it reduces the visual clarity, and especially color perception of the images.

Adjustment of the colors of an image may be employed to preserve the color appearance quality of an image displayed at difference luminance on a display device.

Various example embodiments described herein apply color retargeting approaches aimed at providing a unified frame work for color retargeting of images in which both the image as perceived at a first luminance and the image as displayed at a second luminance are taken into account. According to such color retargeting approaches, a color appearance model is applied to an image to be displayed to produce a simulated version of an image and a color compensation model is applied to produce a compensated version of the image that is ready for displaying on a display device.

The color appearance model refers to a color adjustment technique aimed at reproducing color and color perceptual attributes of a stimulus, such as an image, as the visual system of a human subject would perceive it. The colors and color perceptual attributes of the color compensation model of the stimulus will be perceived differently at different luminance level. More particularly, the color appearance model aims to retarget the colors of the stimulus so as to correspond to what would be perceived by a human subject at any given luminance level.

The image compensation model refers to color adjustment technique aimed at determining the colors of an image based on the luminance of a display device that will display the image. More particularly, the image compensation model aims to adjust the colors of the image so that when it is displayed at a given luminance on the display device, the human subject's perception of displayed image correspond to the original colors of the image.

Referring now to FIG. 1, therein illustrated is a schematic diagram of the operational modules of a color retargeting system 100 according to one example embodiment. The color retargeting system 100 includes a color appearance model module 108 that implements a color appearance model. The color appearance model module 108 receives an input image that corresponds to an input image to be displayed on the display device.

The input image herein refers to any image to be displayed on a display device. The input image may correspond to a still image, which may be represented as matrix of pixels each having a color attribute defined in a color space. The input image may also correspond to a frame of a video, which may also be represented as a matrix of pixels each having a color defined in a color space. Additionally or alternatively, the input image may correspond to the visible content to be displayed on the display device, such as the current screen generated by an operating system or of a software application (ex: browser, desktop, etc.) running on the operating system of a computing device.

The display device herein refers to any electronic device that is operable to display an image and for which the average luminance level of light being emitted from the display device may be controlled, such as by adjusting a brightness setting and/or a backlight setting. For example, the display device may be based on technologies such as quantum dots and OLEDs that have a wider gamut, however older technologies such as conventional CRT and LCD displays are also contemplated. The display device may by any one of computer monitor, television, display of a portable device, such as a smartphone, tablet device, virtual reality device, portable video game device or wearable device.

According to some example embodiments, the color retargeting system 100 may include a first color space transformation module 116 which is applied to the input image prior to being inputted to the color appearance model module 108. The first color space transformation module 116 transforms the input image from its native color space to a color space that is suitable for the color appearance model applied by the color appearance model module 108.

In other example embodiments, the first color space transformation module 116 may be implemented within the color appearance model module 108. Alternatively, color space transformation of the input image may be split between the first color space transformation module 116 and the color appearance model module 108. For example, the first color space transformation module 116 may transform the input image from a first standard color space to a second standard color space that corresponds to the input standard for the color appearance model module 108. The color appearance model module 108 may further transform the input image from the second standard color space to another color space for applying the color appearance model.

The color appearance model module 108 applies the color appearance model to the input image (ex: the native inputted image or the transformed inputted image) based in part on a first luminance level value. The first luminance level value represents a luminance level that is selected for simulating the perception by a human subject of the input image. That is, the color appearance model module 108 adjusts the colors of the input image according to what would be perceived by the human subject if the input image was displayed at the given first luminance level value.

In other example embodiments, the color retargeting system 100 may optionally include an appearance luminance selection module 124. The appearance luminance selection module 124 allows a user of the display device to provide a selection of the first luminance level at which the perception of the input image should be simulated. The selection of the first luminance level may correspond to a user-selected preference for viewing the input image. For example, an interactive visual slider may be presented on the display device for a user to select a desired first luminance level for simulating perception of the input image. Alternatively, the user may select from a plurality of brightness settings (ex: bright, medium light, low light), each setting corresponding to a first luminance level for simulating perception of the input image. The first luminance level may be limited to a range above 10 cd/m$^2$, which corresponds to luminance levels at which a human subject is able to more accurately perceive colors of a stimulus.

The color appearance model module 108 applies the color appearance model to the input image and outputs a first set of color responses representing the simulated version of the input image corresponding to the perception of the input image by the human subject at the first luminance level.

Continuing with FIG. 1, the color retargeting system 100 further includes a color compensation model module 132 that receives as input the first set of color responses outputted by the color appearance model module 108. The color compensation model module 132 applies color compensation to the simulated version of the input image represented by the first set of color responses. The color compensation is applied based in part on a second luminance level value. The second luminance level value represents a luminance level of the display device when displaying the input image after the color compensation.

The color retargeting system 100 may further includes a display luminance selection module 140 that outputs the second luminance level to the color compensation model module 132 upon which the color compensation is based. For example, the display luminance selector module 140 may allow a user of the display device to provide a selection of the second luminance level for displaying images on the display device.

In other examples, the display luminance selector module 140 may automatically determine the second luminance level based on environmental conditions. For example, a light capture device connected to the display device may sense an amount of ambient light surrounding the display device and determine the second luminance level based on the sensed amount of ambient light. For example, the light capture device may be an embedded camera connected to the display device. It will be appreciated that this automatic determination of the second luminance level resembles an "auto-brightness" feature of various display devices, such as one found on mobile devices (ex: tablets, smartphones, portable video game consoles).

The color compensation model module 132 outputs a second set of color responses representing a compensated version of the inputted image. The compensated image corresponds to an image that when displayed at the second luminance level on the display device would be perceived by a human as having an appearance that matches or at least closely approximates the first set of color responses (corresponding to the simulated version of the inputted image). For example, the compensated image displayed on a display device set at the second luminance level would be perceived by the human subject as having an appearance in color that is significantly closer to the first set of color responses than if the inputted image was displayed at the second luminance level without applying the color appearance model and or the color adjustment model.

According to some example embodiments, the color retargeting system 100 may include a second color space transformation module 148 which is applied to the second set of color responses representing the compensated version of the image. The second color space transformation module 148 transforms the compensated version of the image to a color space suitable for displaying on the display device.

According to various example embodiments, first luminance level is significantly higher than the second luminance level. As described elsewhere, the first luminance level may have a value that is greater than 10 cd/m$^2$. For example, the appearance luminance selection module 124 may be configured to limit the selection of the first luminance level to values greater than 10 cd/m$^2$.

The second luminance level may have a value that less than 10 cd/m$^2$. Below this luminance level, human vision enters the mesopic and/or scotopic range.

It will be appreciated that by setting the first luminance level to be significantly higher, the simulated version of the input image corresponds to the input image as if perceived under good lighting conditions. It will be further appreciated that a human subject is able to more accurately perceive colors under such good lighting conditions compared to poorer lighting conditions. By setting the second luminance level to be significantly lower, the compensated image is displayed at the lower luminance level to reduce eye strain but that the image will still be perceived as having colors that approximate the simulated image.

Figure 2:
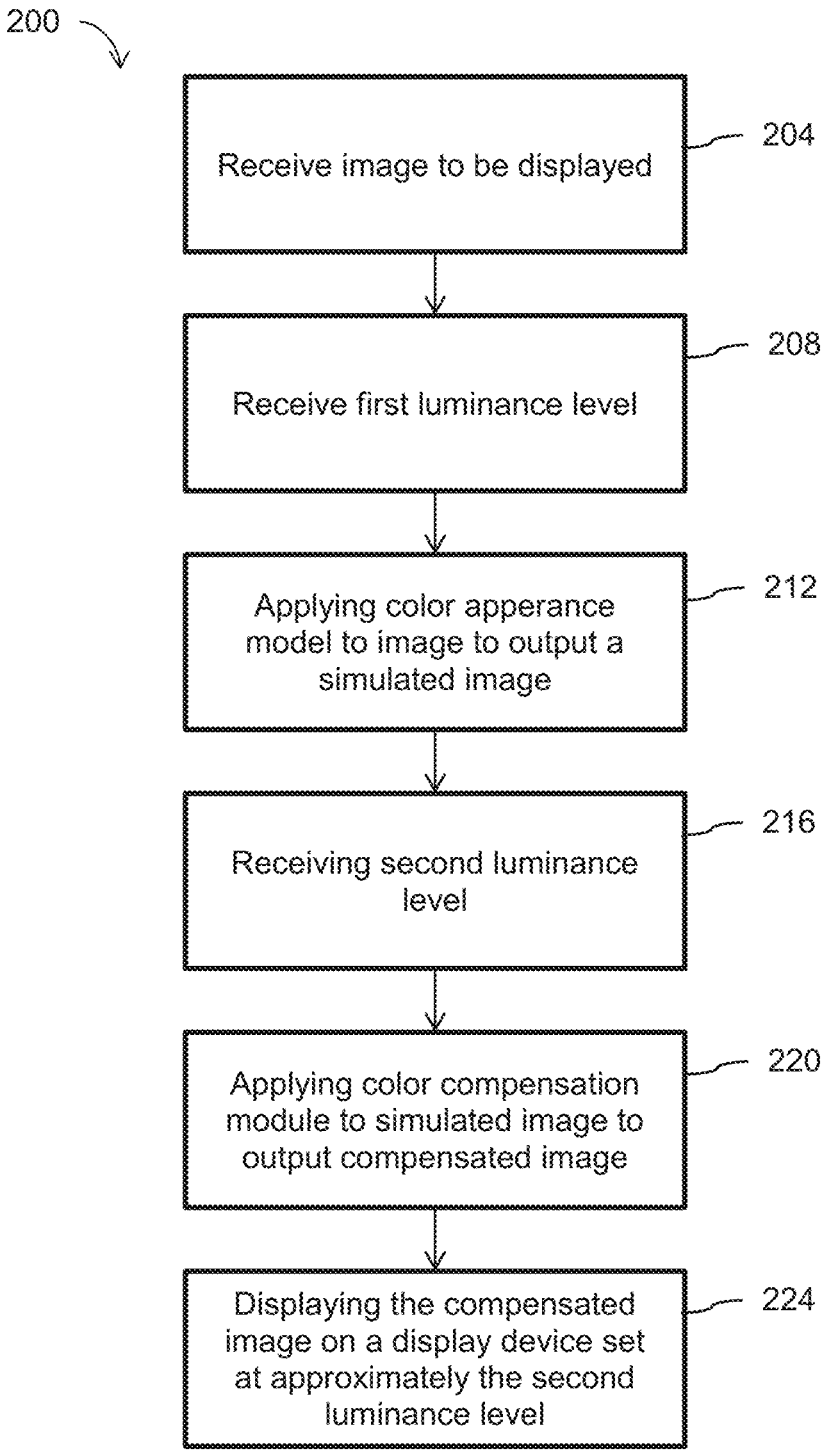
FIG. 2 illustrates a flowchart of the operational steps of a method for retargeting an input image according to one example embodiment.

Referring now to FIG. 2, therein illustrated is a flowchart of the operational steps of a method 200 for retargeting an input image according to one example embodiment.

At step 204, the inputted image to be displayed is received. For example, the inputted image may be an image outputted from an image rendering module of a computing device, such as the video card of the computing device.

At step 208, a first luminance level for applying the color appearance model to the inputted image is received. For example, step 208 may include monitoring user interactions with the computing device to determine whether a current first luminance level has been adjusted, such as, via the appearance luminance selection module 124.

At step 212, the color appearance model is applied to the inputted image based on the current first luminance level. The color appearance model outputs a simulated version of the inputted image.

In some example embodiments, and as described elsewhere herein, the inputted image may be transformed to change color space prior to having the color appearance model applied to it.

At step 216, a second luminance level for applying the color compensation model to the inputted image is received. For example, step 216 may include monitoring user interactions with the computing device to determine whether a current second luminance level has been adjusted, such as, via the display luminance selection module 140.

At step 220, the color compensation model is applied to the simulated version of the inputted image based on the current second luminance level. The color compensation model outputs a compensated version of the inputted image.

In some example embodiments, and as described elsewhere herein, the compensated version of the inputted image may be transformed to a color space suitable for displaying on a display device.

At step 224, the compensated version of the inputted image is displayed on a display device set at approximately the second luminance level.

The method 200 may be performed successively for a series of successive images to be displayed. For example, the successive images may correspond to frames of a video. The successive images to be displayed may also correspond to refreshes of the current screen rendered by an operating system or software application.

According to various example embodiments, at least one of the color appearance model applied by the module 108 and the color compensation model applied by the module 148 includes rod-intrusion correction.

The human visual system works in three different modes called photopic, mesopic and scotopic vision. Photopic vision refers to human vision in daylight situations (high light levels), in which only cones are responsible for human vision. As the light level falls off to a luminance of below 10 cd/m$^2$ [10], the visual system smoothly goes from photopic vision to mesopic vision, in which both cones and rods contribute to visual perception. In the so-called scotopic situation, the light level is lower than the absolute threshold of cone photoreceptors, and human vision is only mediated by rods. The photopic condition has been the main focus of most color research, and the mesopic and scotopic conditions have received much less attention [11].

The color appearance model having rod-intrusion correction refers to the model taking into account the effects of photoreceptor cells, including rods, of a human subject when determining the first set of color responses representing how a given image would be perceived at a given luminance level.

Similarly, the color compensation model having rod-intrusion correction refers to the model taking into account the effects of photoreceptor cells, including rods, of a human subject when determining the second set of color responses.

At least one of the color appearance model and the color compensation model having rod-intrusion mechanism refers to at least one of the models having a mechanism that accounts for use of rods in human vision, such as when viewed using mesopic or scotopic vision. These models may apply an estimate of rod intrusion.

The color appearance model and/or color compensation model having rod-intrusion correction may be distinguished from other color appearance models or color compensation models that do not account for intrusion of rods in human vision. For example, such other color appearance models may transform colors based purely on empirical fits of existing perceptual data over a range of viewing conditions.

Examples of such other models include the CIECAM97c and those described in U.S. publication no. 20110175925 and Laine [32]. The color appearance model and/or color compensation model having rod-intrusion correction refers to a model that takes into account aspects of human color vision in each of the photopic, mesopic, and scotopic luminance ranges.

The output of an ideal color appearance model (CAM) should match human color perception in all viewing conditions. There are many CAMs available in the literature such as Lab, CIECAM97[14] and CIECAM02[15]. However, none of them are close to the ideal model. Most color appearance models have the following limitations: first, they do not take spatial and temporal properties of the human visual system into account; second, they model the appearance of simple stimuli such as color patches;[16] third, they are developed for photopic conditions;[17],[18] fourth, they assume that pixels are independent from each other.[19]

Image color appearance models (iCAMs) have been proposed to fill this gap by incorporating spatial and temporal vision to model the appearance of complex stimuli.[20] However, even these models do not work well in the mesopic range. The iCAM06 model is one example proposed by Kuang et al.,[20] in which the rod contributions are added to the cone responses uniformly. However, recent studies show that the rod contributions to different channels are not the same.[21],[22]

As described above, the color appearance model having rod-intrusion correction includes a mechanism for accounting for use of rods in human vision, such as when viewed using mesopic or scotopic vision. Moreover, the mechanism may account for non-uniform contributions of rods during human vision.

Moreover, existing iCAMs and CAMs are only able to simulate (i.e., predict the appearance of the original scene as a human observer perceives it) the appearance of stimuli. In other words, they are not designed for compensating (i.e., reproducing colors on a rendering medium with a specific viewing condition to match the original scene colors) appearance changes of stimuli rendered on different media with different viewing conditions. For example, when a bright scene is reproduced on a dark display, the contrast degradation and the hue and saturation shift due to mesopic vision will affect the visual appearance of the image content significantly. According to various example embodiments, use of the color compensation model addresses shortcomings of some existing color appearance model.

Referring back to FIG. 1, according to various example embodiments in which the color appearance model includes rod-intrusion correction, the first set of color responses is representative of cone and rod-based human vision. Such a set of color responses may be a set of opponent responses.

Furthermore, where the color compensation model that is applied is configured to receive a set of color responses that is representative of cone and rod-based human vision, the set of color response may be directly inputted into the color compensation model module 132. For example, the color compensation model module 132 receives the set of opponent color responses outputted by the color compensation model module 140 and being representative of the simulated version of the inputted image.

In various example embodiments wherein the color appearance model does not output a first set of color responses that is not representative of cone and rod-based human vision, a further color space transformation may be carried out to transform the first set of color responses to a set of intermediate responses that is representative cone and rod-based human version. This set of intermediate responses following the transformation of the first set of color responses is then inputted into the color compensation model module 148.

The color appearance model may output a first set of color responses that is not representative of cone and rod-based human vision in cases where the color appearance model does not include rod-intrusion correction. Without being tied to a particular theory, rod-intrusion correction may be omitted in the color appearance model where the permitted levels of the first luminance levels are sufficiently high such that rod-intrusion does not provide a significant contribution under human-based vision.

It will be appreciated that output of the first set of color response of the color appearance model module 108 is essentially inputted into the color compensation model without its color information being changed. Accordingly, it is assumed that the compensated image outputted by the color compensation model module 132 applying color compensation on the first set of color responses based on the second luminance level has an appearance when perceived by a human subject that are the same or closely approximates the first set of color responses. As described elsewhere herein, it was observed that applying this assumption to choose the input of the color compensation model module 132 produces a compensated version of the inputted image that provides a good appearance when displayed on a display device at the second luminance level.

According to various example embodiments, the second set of color response outputted by the color compensation model module 132 is also representative of cone and rod-based human vision. For example, the second set of color responses is a set of LMS responses. Accordingly, and as described elsewhere herein, the second set of color responses may be transformed from this color space representative of cone and rod-based human vision to another color space suitable for display on an electronic display device.

According to various example embodiments, where the color appearance model module 108 includes rod-intrusion correction, a first set of rod-weighting coefficients is determined based on the first luminance level. The rod-weighting coefficients are ones that are applied to account for different contributions of different types of rods of human vision under different viewing conditions.

Furthermore, where the color compensation model module 132 includes rod-intrusion correction, a second of set rod-weighting coefficients is determined based on the second luminance level. The second set of rod-weighting coefficients are different from the first set of rod-weighting coefficients due to the first luminance level and the second luminance level being different.

It will be appreciated that while it is assumed that the compensated image outputted by the color compensation model module 132 applied on the first set of color responses based on the second luminance level has an appearance when perceived by a human subject that are the same or closely approximates the first set of color responses, the rod-weighting coefficients are applied differently in the color appearance model and the color compensation model.

According to one example embodiment, a unified framework for a color retargeting system 100 includes a color appearance model and a color compensation model that is the inverse of the color appearance model. According to such an example, the color appearance model should possess two main features: first, the model must be applicable to the entire luminance range of the human visual system (photopic, mesopic and scotopic vision); second, the model must be invertible. A third desirable condition is that the color appearance model is computationally inexpensive so as to permit the color appearance model to be used in real time.

It was observed that there are not many models are available which meet these three conditions. Moreover, most color appearance models are typically developed based on psychophysical experiments over patches, and many have not been used for real images due to their complexity.

Wanat and Mantiuk proposed a retargeting method which consists of global and local contrast retargeting units together with a color retargeting block.[4]

Not many models consider the mesopic and scotopic ranges and rod contributions.[18],[23] Hunt proposed a color appearance model which considers rod responses.[24] Kwak et al. introduced a lightness predictor for mesopic vision to address the stimulus size effect in their model.[25] Other mesopic models may not be CAMs since they do not take the viewing conditions into account. Hence, color vision models cover a greater number of models, which can be less general in terms of considering visual appearance phenomena and might have more limiting assumptions compared with CAMs.

Shin et al. introduced a mesopic model based on psychophysical experiments on color patches, (hereinafter referred to as "Shin's color appearance model").[5] The model adjusts perceptual attributes such as white preference, color saturation and rod contributions to different luminance levels.

Cao et al. proposed another mesopic vision model, [21] which was employed in Kirk's perceptual tone mapping operator for low light conditions [26] and in the color retargeting approach proposed by Wanat and Mantiuk.[4] Rezagholizadeh and Clark proposed a maximum-entropy-based spectral color vision model for mesopic conditions.[23] A comparison of four algorithms that can realistically simulate the appearance of night scenes on a standard display is presented in [27].

Taking the above presented three conditions into account, it was observed that the Cao model and Shin's color appearance model would be qualified to be deployed in the color retargeting system 100.

It was further observed that the Shin model outperformed the Cao model due to the Cao model showing poor performance in reproducing colors at low light levels over both color patches [23] and complex stimuli. [4] This is mainly due to the linearity assumption made in Cao's model between the color and the illuminance, which oversimplifies the color mechanisms of the human visual system.

According to one example embodiment, the color appearance model module 108 of the color retargeting system 100 applies the Shin model as the color appearance model having rod-intrusion correction. Furthermore, the color compensation model module 132 of the color retargeting system 100 applies an inverse of the Shin model as the color compensation having rod-intrusion correction.

Shin et al. proposed a modified version of the Boynton two-stage model with fitting parameters to account for the rod intrusion in mesopic vision.[5] The goal of the model is to find the matching colors in the photopic range for the input colors in themesopic range. The parameters of the model are obtained as a function of the luminance based on asymmetric color matching experimental data. In their experiment, the observer is presented with a Munsell color chip under mesopic conditions and is asked to match the appearance of that patch with the simulated image reproduced by the model in the CRT display under photopic conditions.

Shin's color appearance model includes:

1. The XYZ image (i.e., the RGB image which is transformed to the XYZ color space) is input to the model and is converted to the LMS space in the first step:

$$[XYZ]^t = M_{rgb2xyz} \cdot [RGB]^t$$

$$LMS = [L_p M_p S_p]^t = M_{xyz2LMS} \cdot XYZ$$

2. The LMS signals are substituted into the opponent channel equations of the Boynton two-stage model:

$$A(E) = \alpha(E) K_w((L_p + M_p)/(L_{pw} + M_{pw})) + \beta(E) K'_w (Y'/Y'_w)^\gamma$$

$$r/g(E) = l(E)(L_p - 2M_p) + a(E) Y'$$

$$b/y(E) = m(E)(L_p + M_p - S_p) + b(E) Y'$$

where E represents the luminance of the scene; A(E), r/g(E) and b/y(E) are the achromatic, red/green and blue/yellow opponent responses, respectively; the indices p and w indicate "photopic" and "white point," respectively; Y' represents the scotopic luminance; α(E), β(E), l(E), a(E), m(E), and b(E) are the rod-weighting coefficients indicating the relative contributions of the rod's response to the opponent channels and $K_w$ and $K'_w$ are the maximum responses of the luminance channel in photopic and scotopic conditions.

3. Then, the opponent responses, A(E), r/g(E) and b/y(E), are transformed back to the XYZ space and then to the RGB space:

$$[X_m Y_m Z_m]^t = M_{opp2xyz} \cdot [A(E) r/g(E) b/y(E)]^t$$

where $X_m$, $Y_m$ and $Z_m$ represent the mesopic XYZ values as they can be seen in photopic conditions. The parameters of the Shin model are selected according to Table I. rod-weighting coefficients (α(E), β(E), l(E), a(E), m(E), and b(E)) are evaluated based on interpolation over the given points in Table III (table 1 of [5]). The transformation matrixes used in the model are listed in Table II.

TABLE I

Parameters of Shin's color appearance model

| Parameter | Value |
|---|---|
| $K_w$ | 1 |
| $K_w'$ | 78.4 |
| γ | 0.77 |

TABLE II

Transformation matrixes used in Shin's color appearance model

| Parameter | Value |
|---|---|
| $M_{rgb2xyz}$ | $\begin{bmatrix} 0.4124 & 0.3576 & 0.1805 \\ 0.2126 & 0.7152 & 0.0722 \\ 0.0193 & 1.1192 & 0.9505 \end{bmatrix}$ |
| $M_{xyz2LMS}$ | $\begin{bmatrix} 1.008 & 2.149 & -0.212 \\ 1 & - & 0 \\ 1 & 0 & -1 \end{bmatrix}$ |

TABLE II-continued

Transformation matrixes used in Shin's color appearance model

| Parameter | Value |
|---|---|
| $M_{opp2xyz}$ | $\begin{bmatrix} 1.008 & 2.149 & -0.212 \\ 1 & - & 0 \\ 1 & 0 & -1 \end{bmatrix}$ |

TABLE III

Weighting coefficients of the model with illuminance level

| Weighting | Luminance | | | | | |
|---|---|---|---|---|---|---|
| Coefficient | 0.01 | 0.1 | 1 | 10 | 100 | 1000 |
| α(E) | 0 | 0.042 | 0.222 | 0.356 | 0.735 | 1 |
| β(E) | 0.829 | 0.722 | 0.512 | 0.312 | 0.070 | 0 |
| l(E) | 0.020 | 0.049 | 0.188 | 0.409 | 0.748 | 1 |
| m(E) | 0.017 | 0.042 | 0.132 | 0.307 | 0.689 | 1 |
| a(E) | −0.033 | −0.028 | −0.014 | 0.006 | 0.015 | 0 |
| b(E) | 0.075 | 0.063 | 0.094 | 0.107 | 0.073 | 0 |

Shin's color appearance model is applied as the color appearance model to the input image based the selected first luminance level to determine the first set of color responses representing the simulated version of the input image if it were perceived by the human subject at the first luminance level. Accordingly, the first luminance level described herein corresponds to the luminance E of Shin's color appearance model.

The goal of applying the inverse of Shin's color appearance model as the compensation model is to take the first set of responses outputted from the color appearance model (perceived inputted image at the intended luminance based on the Shin model) and predict the color values of the compensated image such that the color appearance of this compensated image rendered on a display device with a specific luminance value resembles the perceived inputted image.

According to one example embodiment, the color compensation model that is the inverse of Shin's model is applied based on the second luminance level and by inputting the first set of color responses from the Shin model as the color adjustment model. The output of the inverse of the Shin model is the compensated version of the inputted image.

More particularly, applying the inverse of Shin's color appearance model as the color compensation model includes the following.

1. The output of Shin's color appearance model as the color appearance model being the first set of color responses opponent responses (A(E), r/g(E) and b/y(E)) are inputted into the inverse of Shin's color appearance model being applied as the image compensation model. As described elsewhere herein, this is carried out based on the assumption that the compensated image outputted by the inverse of Shin's color appearance model as the color compensation model at the second luminance level produces opponent responses when perceived by a human subject that are the same or closely approximates the opponent responses of the first set of color responses of Shin's color appearance model as the color appearance model applied at the first luminance level. Accordingly, the second luminance level described herein corresponds to the luminance E of the inverse of Shin's color appearance model.

2. A second set of rod-weighting coefficients of the inverse of Shin's color appearance model $\alpha(\overline{E})$, $\beta(\overline{E})$, $l(\overline{E})$, $a(\overline{E})$, $m(\overline{E})$, and $b(\overline{E})$ are determined for the second luminance level $\overline{E}$ for displaying the compensated version of the inputted image on the display device. The second set of rod-weighting coefficients may also be determined based on the Table III applied for determining the first set of rod-weighting coefficients in Shin's color appearance model applied as a color appearance model.

3. The second set of rod-weighting coefficients and the first set of color responses are substituted into Shin's color appearance model and the $\overline{LMS}$ values of the compensated image are obtained as follows:

$$\overline{L_p} + \overline{M_p} = ((L_{pw} + M_{pw})/\alpha(\overline{E})K_w) \times (A(E) - \beta(\overline{E})K'_w(Y'/Y'_w)^{\gamma})$$

$$\overline{L_p} - 2\overline{M_p} = \frac{(r/g(E) - a(\overline{E}) \times Y')}{l(\overline{E})}$$

$$\overline{L_p} + \overline{M_p} - \overline{S_p} = \frac{(b/y(E) - b(\overline{E}) \times Y')}{m(\overline{E})}$$

4. The left-hand side variables are transformed to $\overline{L_p}$, $\overline{M_p}$ and $\overline{S_p}$ using a simple linear transformation:

$$\begin{bmatrix} \overline{L_p} \\ \overline{M_p} \\ \overline{S_p} \end{bmatrix} = \begin{bmatrix} 1 & 1 & 0 \\ 1 & -2 & 0 \\ 1 & 1 & -1 \end{bmatrix}^{-1} \begin{bmatrix} \overline{L_p} + \overline{M_p} \\ \overline{L_p} - 2\overline{M_p} \\ \overline{L_p} + \overline{M_p} - \overline{S_p} \end{bmatrix}$$

5. A linear transformation is applied to convert the $\overline{LMS}$ values to $\overline{XYZ}$ and subsequently to $\overline{RGB}$ values.

In some example embodiments, white point LMS values and a scotopic luminance value $\overline{Y'}$ are determined based on the second luminance level $\overline{E}$ and are also substituted into the Shin model.

The white point LMS may be calculated as:

$$\overline{LMS_w} = [\,\overline{L_w} \quad \overline{M_w} \quad \overline{S_w}\,]^t = \frac{\overline{E}}{E}[\,L_{pw} \quad M_{pw} \quad S_{pw}\,]^t$$

and the scotopic luminance value $\overline{Y'}$ may be calculated:

$$\overline{Y'} = \frac{\overline{E}}{E} \times Y'$$

Accordingly, the equations above may be rewritten as:

$$\overline{L_p} + \overline{M_p} = ((L_{pw} + M_{pw})/\alpha(\overline{E})K_w) \times \left(A(E) - \beta(\overline{E})K'_w\left(\overline{Y'}/\overline{Y'_w}\right)^{\gamma}\right)$$

$$\overline{L_p} - 2\overline{M_p} = \frac{\left(r/g(E) - a(\overline{E}) \times \overline{Y'}\right)}{l(\overline{E})}$$

$$\overline{L_p} + \overline{M_p} - \overline{S_p} = \frac{\left(b/y(E) - b(\overline{E}) \times \overline{Y'}\right)}{m(\overline{E})}$$

While the Shin's color appearance model and the inverse of Shin's color appearance model have been described as the color appearance model and the color compensation model, respectively, in other examples, only the Shin's color appearance model may be applied as the color appearance model while a different color compensation model is applied. Alternatively, only the inverse of the Shin's color appearance model is applied as the color compensation model while a different color appearance model is applied.

EXPERIMENTAL RESULTS

A color retargeting system 100 applying the Shin model within the color appearance model module 108 and the inverse Shin model within the color compensation model module 132 is evaluated using quantitative and qualitative experiments (herein after referred to as the "test color retargeting system").

Quantitative Evaluation

Figure 3:
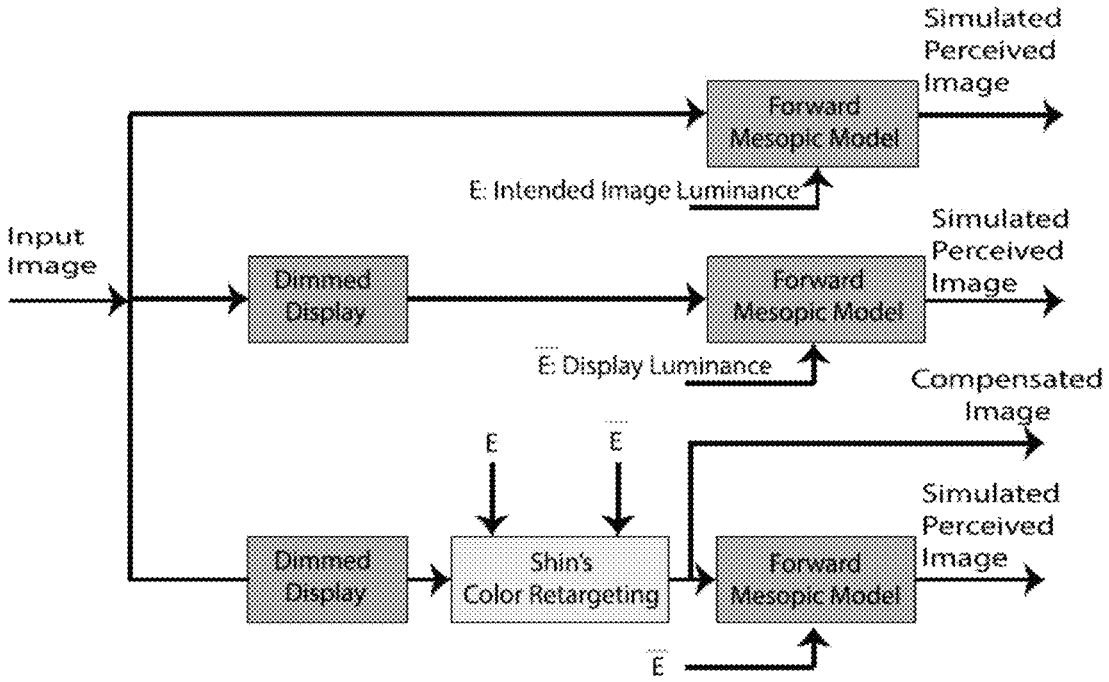
FIG. 3 illustrates a schematic diagram of an evaluation procedure for evaluating various color adjustment methods.
Figure 4A:
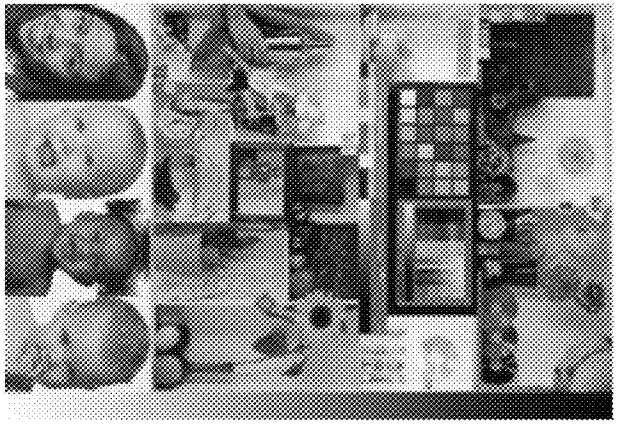
FIG. 4*a* is an original multi-object image as perceived on a bright display of $L_{src}$=250 cd/m$^2$.
Figure 4B:
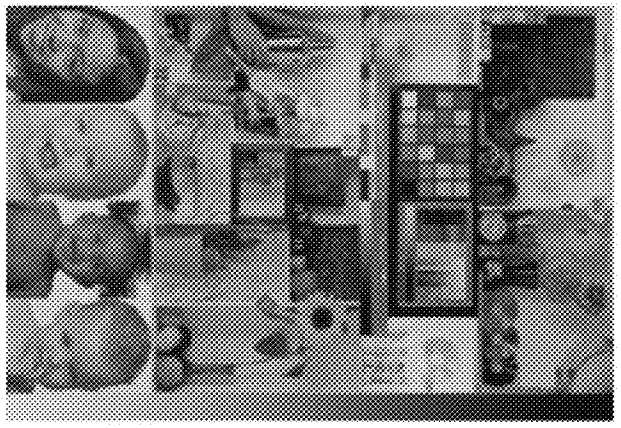
FIG. 4*b* is an original multi-object image as perceived on a dimmed display of $L_{dest}$=2 cd/m$^2$.
Figure 4C:
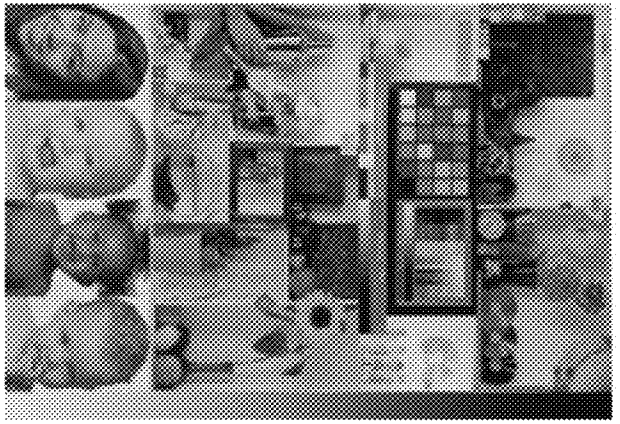
FIG. 4*c* is a compensated multi-object image as perceived on a dimmed display of $L_{dest}$=2 cd/m$^2$.
Figure 4D:
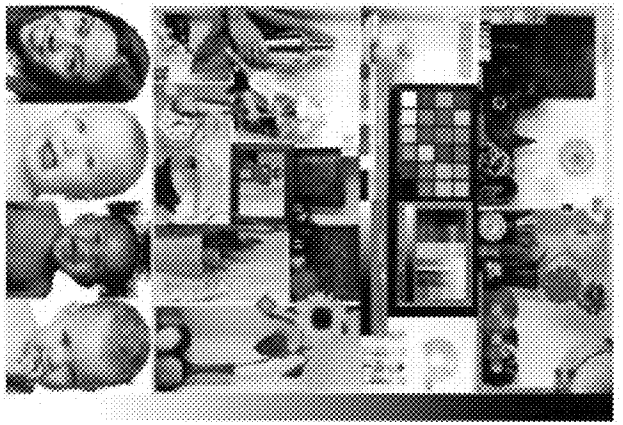
FIG. 4*d* is a compensated multi-object image for displaying onto a dimmed display of $L_{dest}$=2 cd/m$^2$.
Figure 4F:
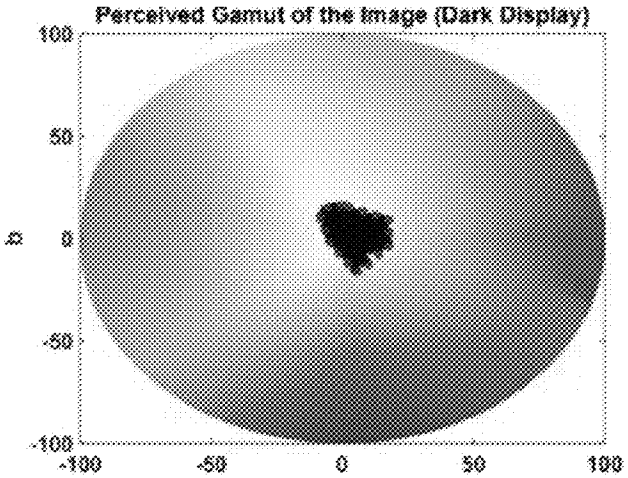
FIG. 4*f* is the simulated perceived gamut of the multi-object image displayed on the dimmed display.
Figure 4E:
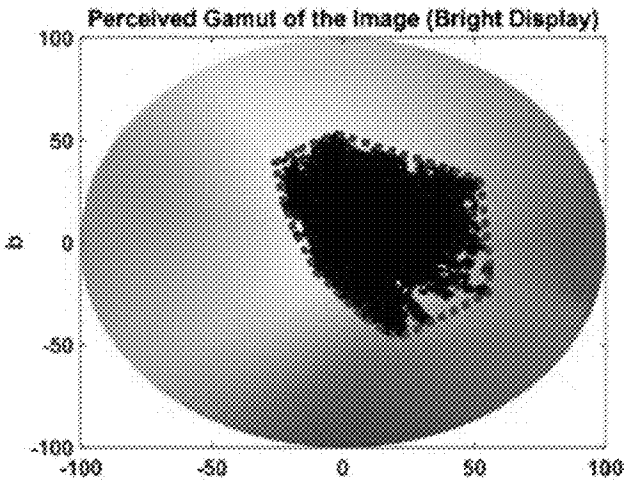
FIG. 4*e* is the simulated perceived gamut of the multi-object image displayed on the bright display.
Figure 4H:
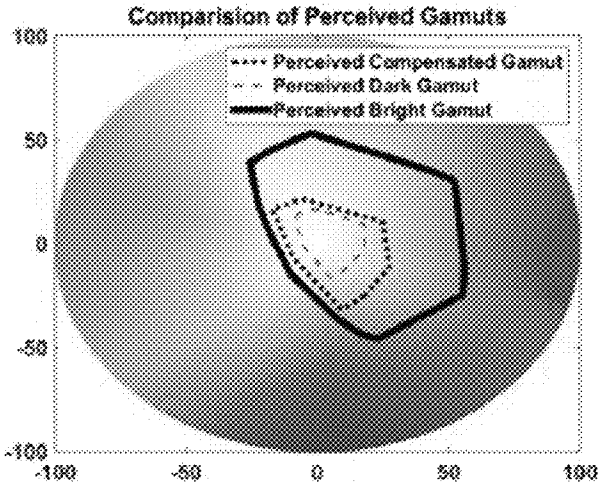
FIG. 4*h* is the comparison of the gamuts of FIGS. 4*e*, 4*f* and 4*g;*
Figure 4G:
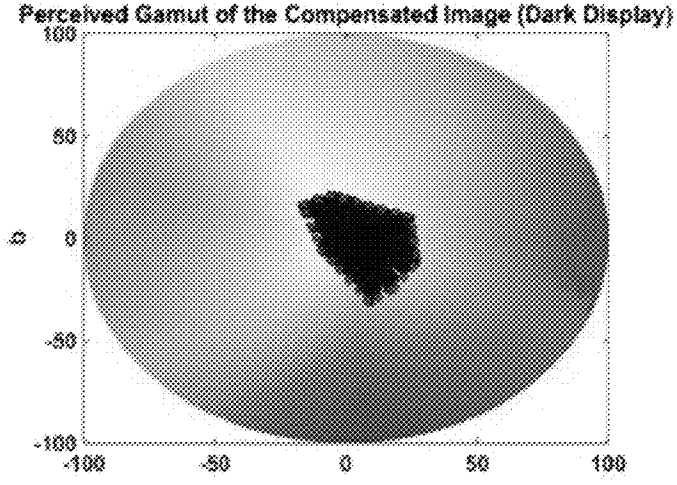
FIG. 4*g* is the simulated perceived gamut of the compensated multi-object image displayed on the dimmed display.
Figure 5B:
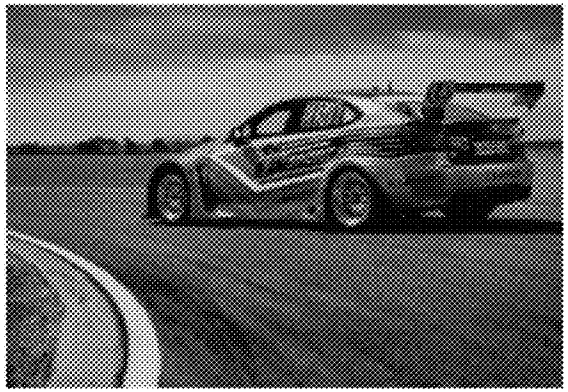
FIG. 5*b* is an original car image as perceived on a dimmed display of $L_{dest}$=2 cd/m$^2$.
Figure 5D:
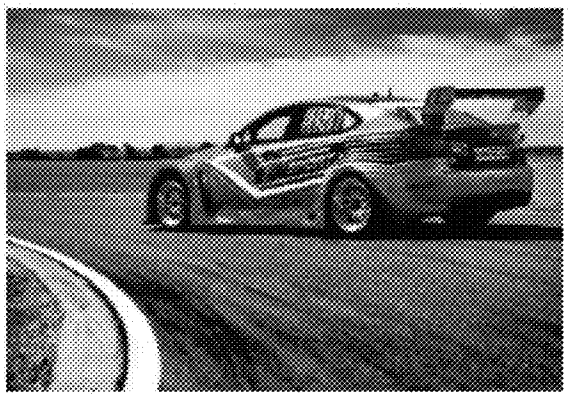
FIG. 5*d* is a compensated car image for displaying onto a dimmed display of $L_{dest}$=2 cd/m$^2$.
Figure 5A:
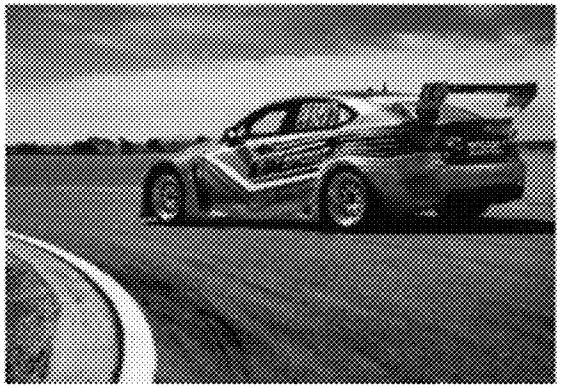
FIG. 5*a* is an original car image as perceived on a bright display of $L_{src}$=250 cd/m$^2$.
Figure 5C:
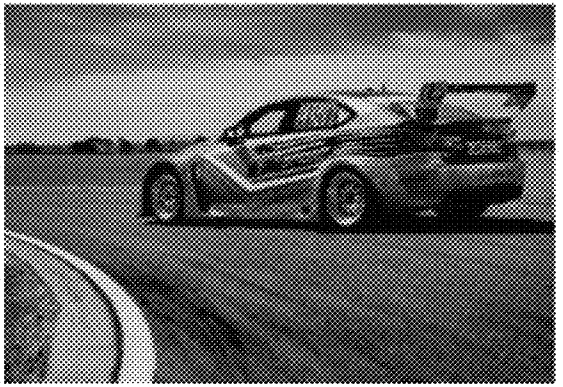
FIG. 5*c* is a compensated car image as perceived on a dimmed display of $L_{dest}$=2 cd/m$^2$.
Figure 5E:
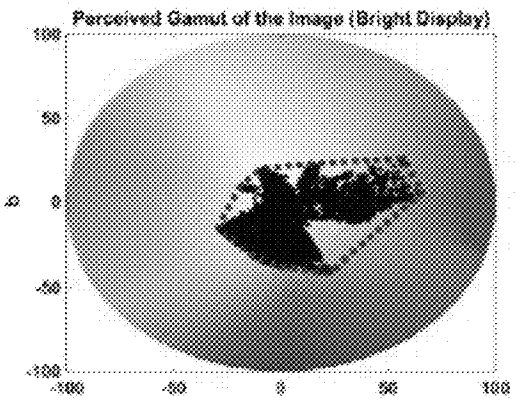
FIG. 5*e* is the simulated perceived gamut of the car image displayed on the bright display.
Figure 5F:
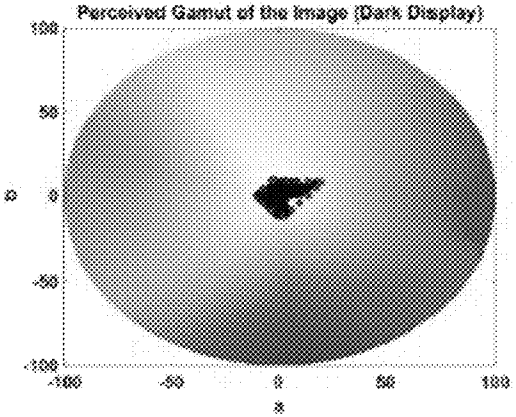
FIG. 5*f* is the simulated perceived gamut of the car image displayed on the dimmed display.
Figure 5G:
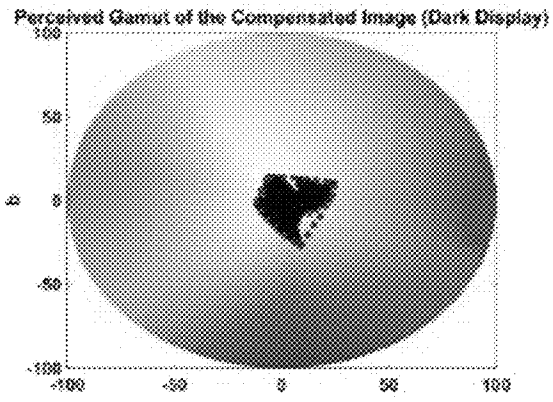
FIG. 5*g* is the simulated perceived gamut of the compensated car image displayed on the dimmed display.
Figure 5H:
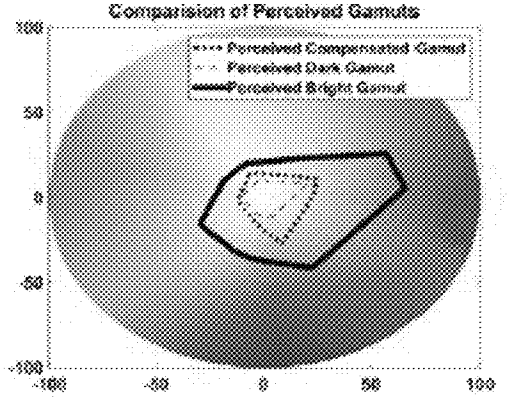
FIG. 5*h* is the comparison of the gamuts of FIGS. 5*e*, 5*f* and 5*g;*
Figure 6B:
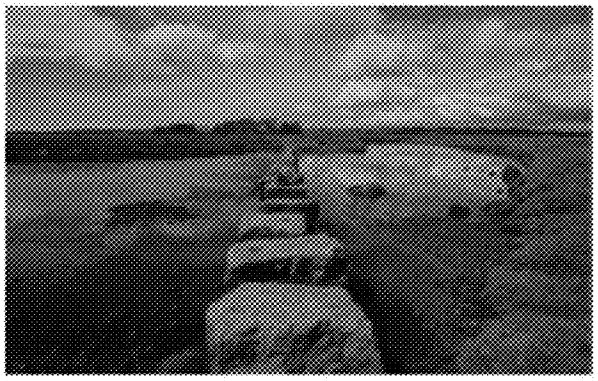
FIG. 6*b* is an original walk stones image as perceived on a dimmed display of $L_{dest}$=2 cd/m$^2$.
Figure 6D:
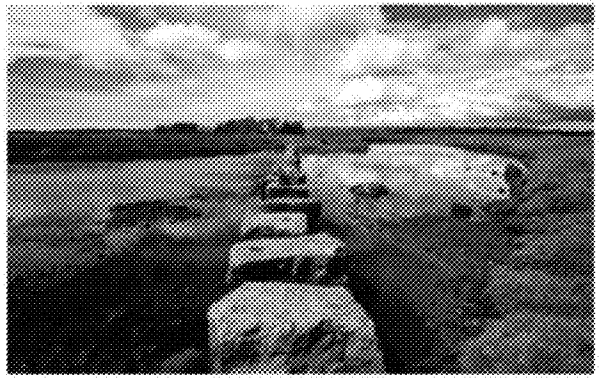
FIG. 6*d* is a compensated walk stones image for displaying onto a dimmed display of $L_{dest}$=2 cd/m$^2$.
Figure 6A:
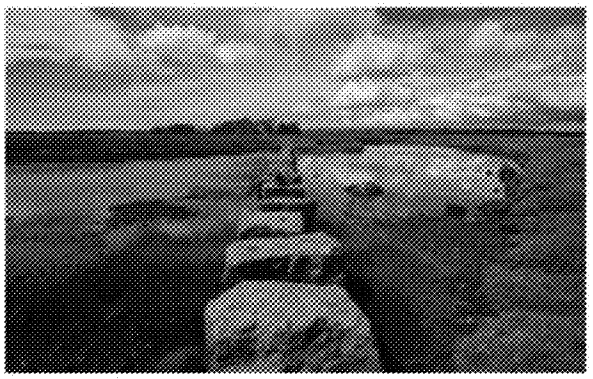
FIG. 6*a* is an original walk stones image as perceived on a bright display of $L_{src}$=250 cd/m$^2$.
Figure 6C:
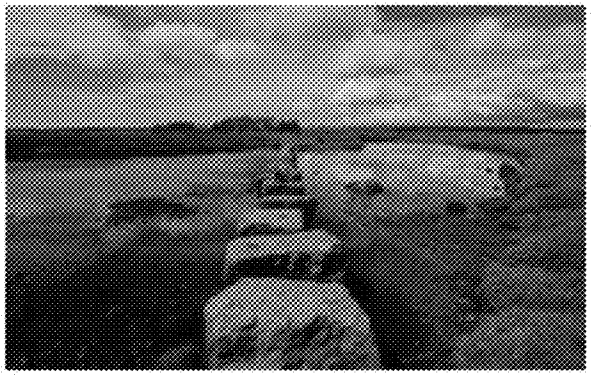
FIG. 6*c* is a compensated walk stones image as perceived on a dimmed display of $L_{dest}$=2 cd/m$^2$.
Figure 6E:
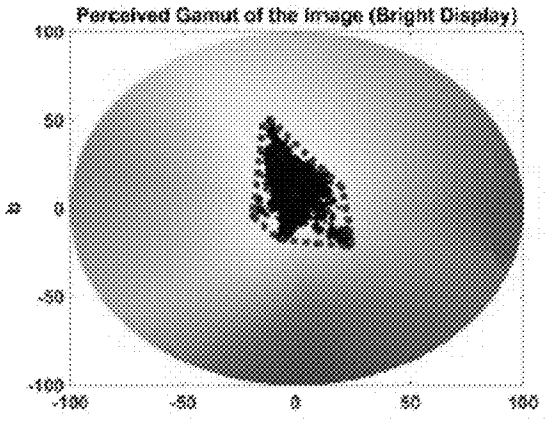
FIG. 6*e* is the simulated perceived gamut of the walk stones image displayed on the bright display.
Figure 6F:
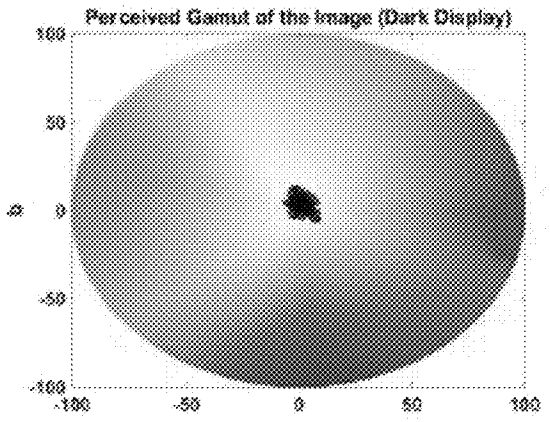
FIG. 6*f* is the simulated perceived gamut of the walk stones image displayed on the dimmed display.
Figure 6G:
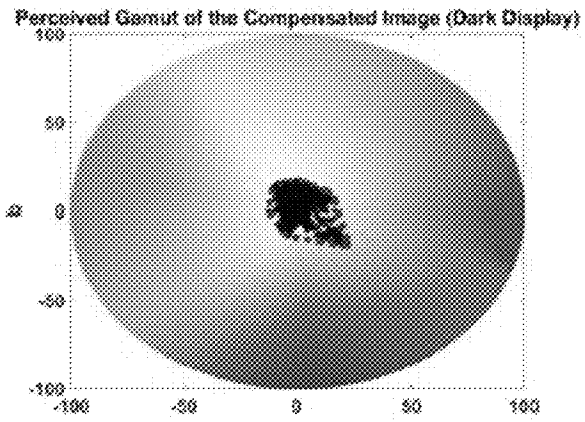
FIG. 6*g* is the simulated perceived gamut of the compensated walk stones image displayed on the dimmed display.
Figure 6H:
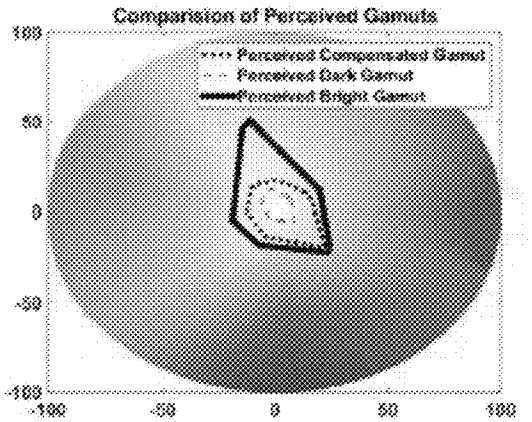
FIG. 6*h* is the comparison of the gamuts of FIGS. 6*e*, 6*f* and 6*g;*
Figure 7B:
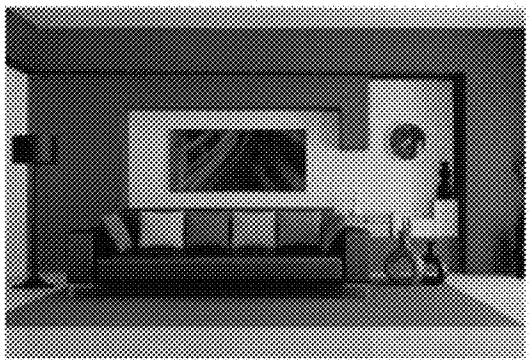
FIG. 7*b* is an original red room image as perceived on a dimmed display of $L_{dest}$=2 cd/m$^2$.
Figure 7D:
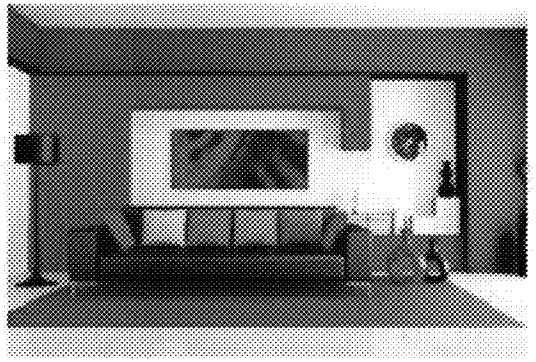
FIG. 7*d* is a compensated red room image for displaying onto a dimmed display of $L_{dest}$=2 cd/m$^2$.
Figure 7A:
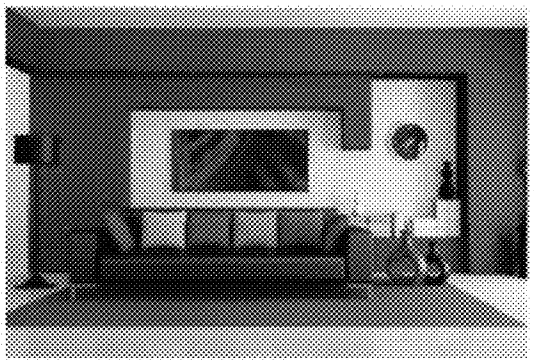
FIG. 7*a* is an original red room image as perceived on a bright display of $L_{src}$=250 cd/m$^2$.
Figure 7C:
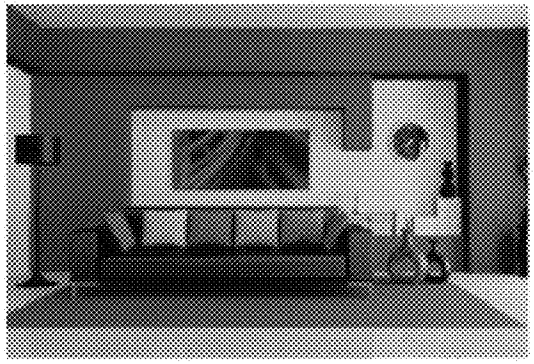
FIG. 7*c* is a compensated red room image as perceived as perceived on a dimmed display of $L_{dest}$=2 cd/m$^2$.
Figure 7F:
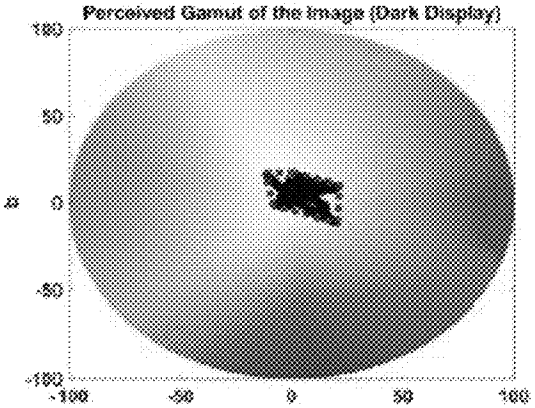
FIG. 7*f* is the simulated perceived gamut of the red room image displayed on the dimmed display.
Figure 7H:
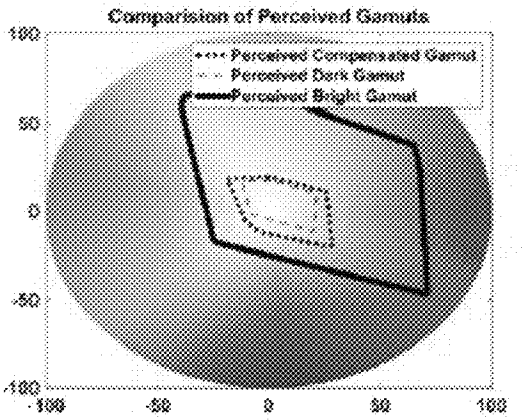
FIG. 7*h* is the comparison of the gamuts of FIGS. 7*e*, 7*f* and 7*g;*
Figure 7E:
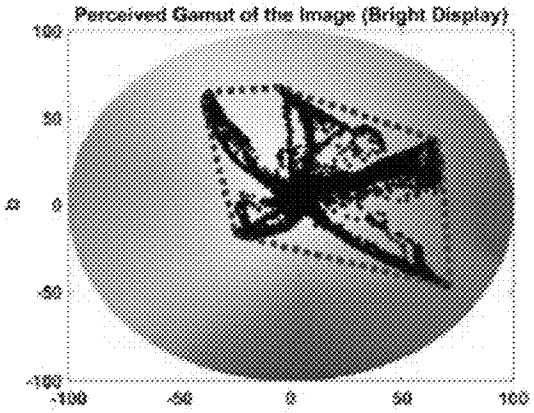
FIG. 7*e* is the simulated perceived gamut of the red room image displayed on the bright display.
Figure 7G:
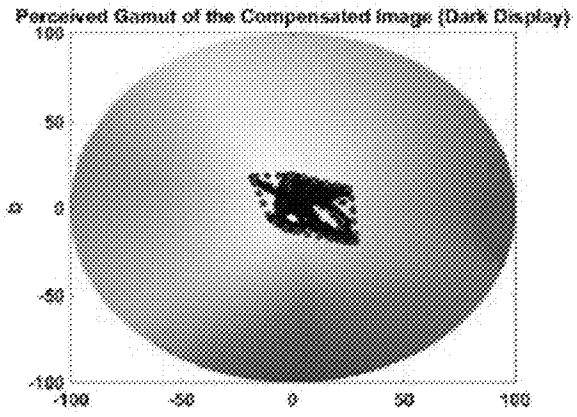
FIG. 7*g* is the simulated perceived gamut of the compensated red room image displayed on the dimmed display.

In the quantitative experiment, the human subject is replaced by the Shin's color appearance model, to predict the human observer color perception at low light levels. The evaluation procedure of the qualitative evaluation is depicted in FIG. 3. Shin's color appearance model is employed to simulate the perceived image at different luminance levels. This model takes in an image, the reference white and the light level under which the image is viewed. The output of the model is the simulated perceived image in photopic conditions in the XYZ space. To derive the corresponding color perceptual attributes, the XYZ values and the reference white can be given to the LAB space.

The experiment is conducted on four images, {Multi-object Scene, Car, Walk Stones, Red Room}, where the images are viewed in a dark surround, and the results are shown in FIGS. 4*a* to 7*g*. Each of the figures shows (a) the simulated perceived original image on a bright display ($L_{src}$=250 cd/m$^2$), (b) the simulated perceived original image on a dark display ($L_{dest}$=2 cd/m$^2$), (c) the simulated perceived compensated image on a dark display with the same brightness level, (d) the compensated image, (e) the simulated perceived gamut of the image shown in (a), (f) the simulated perceived gamut of the unprocessed image on a dark display, (g) the simulated perceived gamut of the compensated image viewed on a dark display and (h) a comparison of the three simulated perceived gamuts depicted in (e) to (g). It is worth mentioning that the gamut of each image is shown in the LAB space, which is approximately a perceptually uniform color space.

The results of FIGS. 4*a* to 7*g* show that the compensated image has a larger simulated perceived gamut and a better simulated color appearance in dark conditions compared with the unprocessed image viewed in the same conditions. For example, in the Multi-object Scene image in FIGS. 4(*a*) to 4(*d*), a comparison of the checker board colors in FIGS. 4(*b*) and 4(*c*) to show that the colors in the simulated perceived compensated image more closely resemble the colors in FIG. 4(*a*); or in the Car image, the blue color of the sky and the car is maintained better compared with the unprocessed image on the dark display. The simulated perceived unprocessed Walk Stone image shows washed out colors, while in the simulated perceived compensated image, the blue sky, green grass and brown stones are visible more clearly. FIG. 6(*h*) demonstrates that the simulated perceived gamut of the unprocessed image in dark conditions is shrunk to the center of the ab-chromaticity diagram (achromatic region), and the simulated perceived gamut of the compensated image brings back a fairly large portion of the lost simulated perceived color gamut. In FIG. 7(*d*), the red color of the wall, the carpet on the wall are more vivid in the dark compensated image compared with the unprocessed image.

To evaluate the color appearance quality of images quantitatively, a color difference metric can be employed. A particular application of quantitative assessment techniques is to replace a human subject in evaluating the quality of images, which accordingly gives rise to a less expensive, more effective, more repeatable and consistent, and more time efficient approach. The metric used for this purpose should be based on a comprehensive color appearance model. There are several color difference measures in the literature, such as $\Delta E_{xy}$, $\Delta E_{ab}$, $\Delta E_{94}$, and $\Delta E_{00}$; however, none of them give an ideal perceptual measure to be used with complex images. In spite of the reported limitations and deficiencies of these measures, they are the only available metrics for quantitative color quality assessment and have been used in the literature extensively. Hence, the quantitative evaluation of the test color retargeting system is carried out as follows.

The chromaticity difference measure $\Delta E_{94}^c$ is derived from the well-known color difference metric $\Delta E_{94}$ by removing the lightness component from the $\Delta E_{94}$ formula. $\Delta E_{94}^c$ is used to evaluate the chromaticity deviation of simulated perceived uncompensated and compensated images on the dimmed display compared with the perceived colors of the original scene:

$$\Delta E_{94}^c = \sqrt{\left(\frac{\Delta C_{ab}^*}{k_C S_C}\right)^2 + \left(\frac{\Delta H_{ab}^*}{k_H S_H}\right)^2}$$

where $$C_1^* = \sqrt{(a_1^*)^2 + (b_1^*)^2}$$

$$C_2^* = \sqrt{(a_2^*)^2 + (b_2^*)^2}$$

$$\Delta a^* = a_1^* - a_2^*$$

$$\Delta b^* = b_1^* - b_2^*$$

$$\Delta H_{ab}^* = \sqrt{(\Delta a_2^*)^2 + (\Delta b_2^*)^2 - (\Delta C_{ab}^*)^2}$$

$$S_C = 1 + K_1 C_1^*$$

$$S_H = 1 + K_2 C_1^*$$

and where ($a^*_1$, $b^*_1$) and ($a^*_2$, $b^*_2$) refer to the (a*, b*) values of two CIE 1976 L*a*b* coordinates, $K_1$ is set to 0.045, $K_2$=0.015 and $K_c$=$K_H$=1. [29]

The results for the perceptual chromaticity differences between the dark and bright images for both the uncompensated and the compensated approaches of FIGS. 4*a* to 7*d* are shown in Table IV. Table IV provides the mean $\Delta E_{94}^c$ measure between a test image viewed at $L_{dest}$=2 cd/m$^2$ and the perceived original image at $L_{src}$=250 cd/m$^2$. The $\Delta E_{94}^c$ measure for the compensated images is reduced by a factor of almost 2 compared with that of the uncompensated images.

TABLE IV

Mean $\Delta E_{94}^c$ measure between a test image viewed at $L_{dest}$ = 2 cd/m$^2$ and the perceived original image at 250 cd/m$^2$

| Test image | Unprocessed | Test color retargetting system | Wanat | iCam06 |
|---|---|---|---|---|
| Multi-object scene | 5.0 | 2.80 | 4.37 | 5.62 |
| Car | 5.05 | 2.23 | 4.36 | 7.23 |
| Walk stones | 5.22 | 2.65 | 4.54 | 5.74 |
| Red Room | 7.79 | 4.39 | 7.09 | 7.42 |
| Blue Room | 6.19 | 3.36 | 5.43 | 8.26 |
| Horse | 6.58 | 3.45 | 7.17 | 10.93 |
| Flower | 23.61 | 21.17 | 24.15 | 31.13 |

Another quantitative measure is the percentile coverage of the simulated perceived gamut of images in the dark relative to the simulated perceived gamut of the bright image (i.e., the proportion of the overlapping area of the simulated perceived gamut of the dark image with the simulated perceived gamut of the original bright image). This measure is herein referred to as the effective gamut ratio (EGR). The EGR index is used to evaluate the performance of test color retargeting system in compensating the shrunk gamut area of the simulated perceived unprocessed image, and the results are reported in Table V. Table V illustrates the EGR index (the percentile coverage of the perceived gamut (%)) between a test image viewed at $L_{dest}$=2 cd/m$^2$ and the perceived original image at $L_{src}$=250 cd/m$^2$. The EGR measure is shown to be almost two times larger for the compensated images with test color retargeting system compared with the unprocessed ones, and the EGR of the walk stones image is enhanced by a factor of 4.

| Test image | Unprocessed | Test color retargetting system | Wanat | iCam06 |
|---|---|---|---|---|
| Multi-object scene | 10.3 | 25.9 | 12.0 | 9.9 |
| Car | 9.2 | 22.1 | 10.2 | 10.0 |
| Walk stones | 9.1 | 43.0 | 14.8 | 20.5 |
| Red Room | 7.6 | 14.3 | 7.7 | 9.9 |
| Blue Room | 13.5 | 36.3 | 14.8 | 17.7 |
| Horse | 9.7 | 25.8 | 9.92 | 14.2 |
| Flower | 7.2 | 15.8 | 7.6 | 15.3 |

Table V Illustrates the EGR Index (the Percentile Coverage of the Perceived Gamut (%)) between a Test Image Viewed at $L_{dest}$=2cd/m$^2$ and the Perceived Original Image at $L_{src}$=250cd/m$^2$.

Figure 8A:
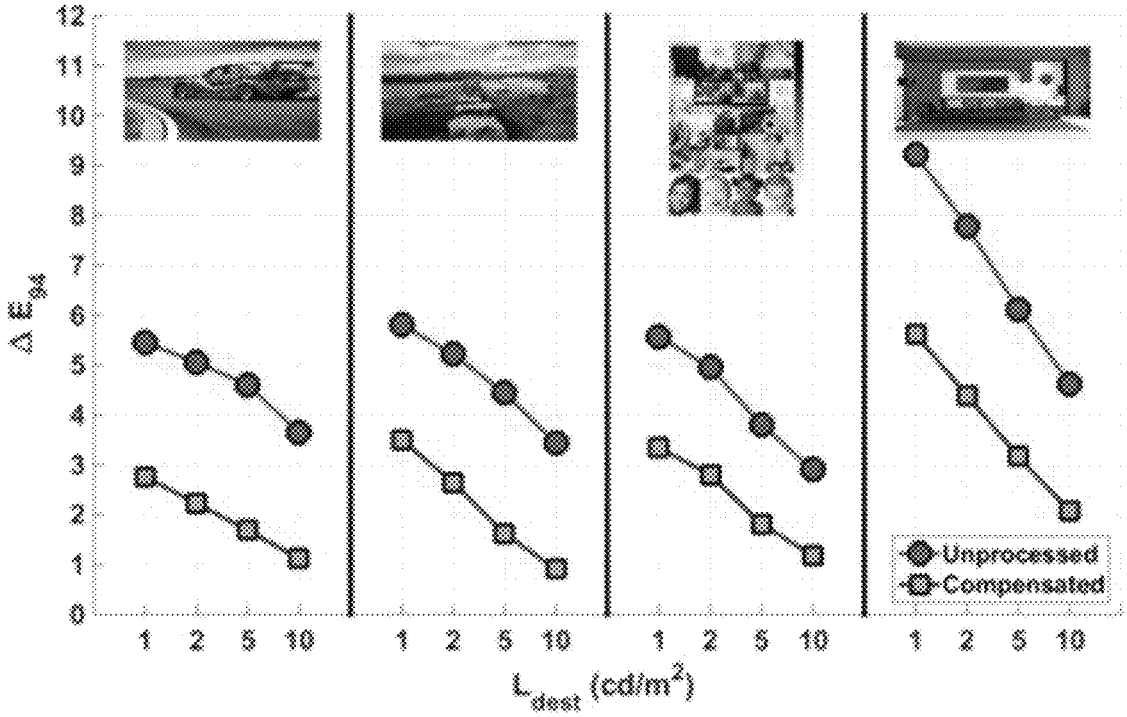
FIG. 8*a* displays the $\Delta E_{94}^{c}$ indices of the multi-object, car, walk stones, and red room images displayed at values of 1, 2, 5 and 10 cd/m$^2$.
Figure 8B:
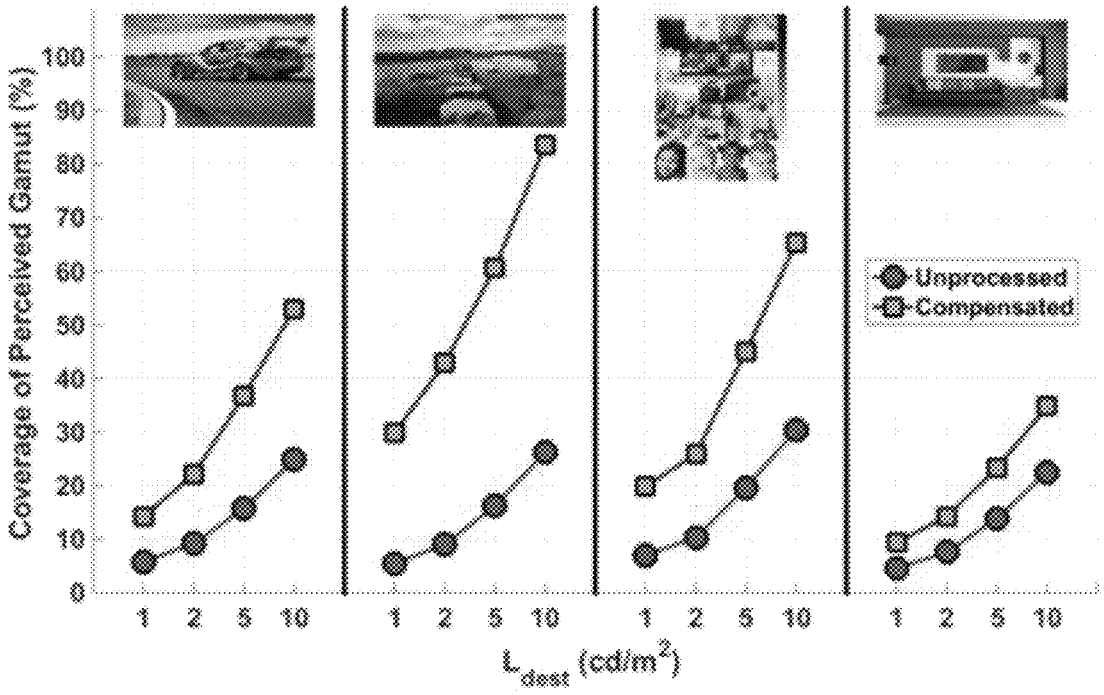
FIG. 8*b* displays the EGR indices of the multi-object, car, walk stones, and red room images displayed at values of 1, 2, 5 and 10 cd/m$^2$.
Figure 9A:
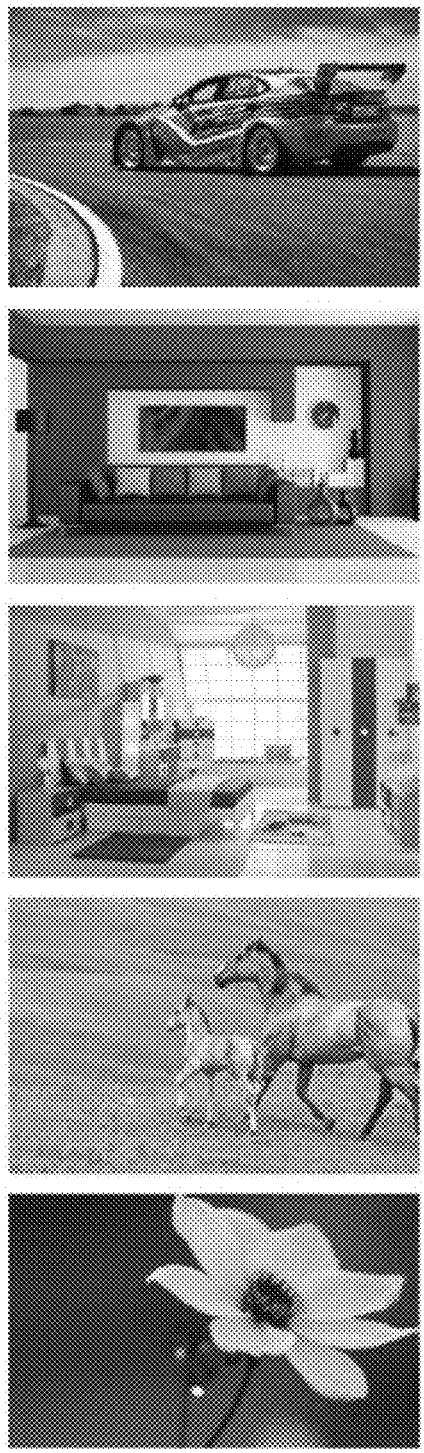
FIG. 9*a* shows five original images used for comparison in experimental evaluations.
Figure 9B:
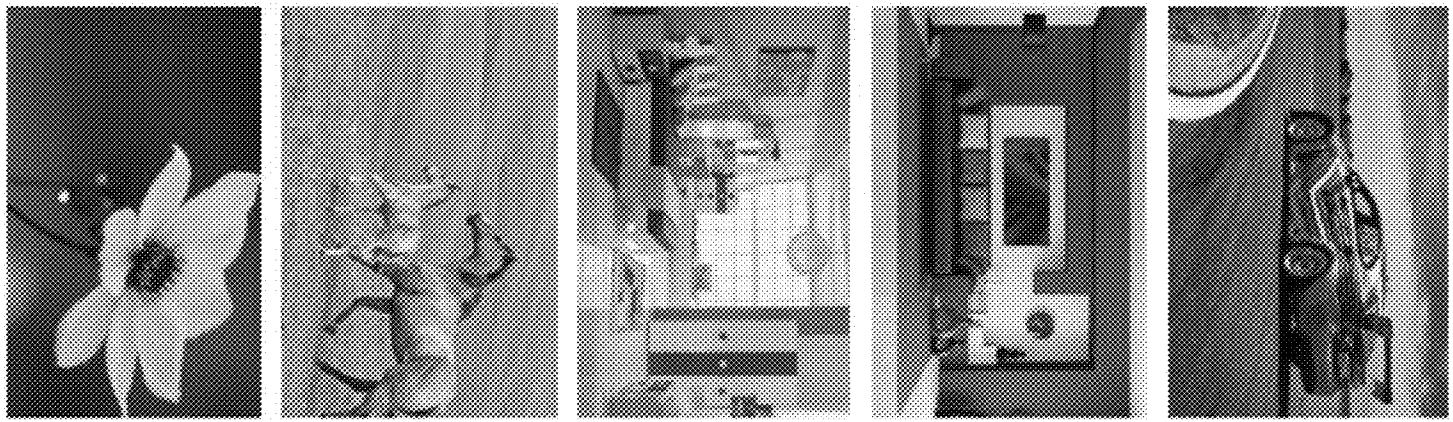
FIG. 9*b* shows the five original images according to the approach of Wanat and Mantiuk using $L_{src}$=250 cd/m$^2$ and $L_{dest}$=2 cd/m$^2$.
Figure 9C:
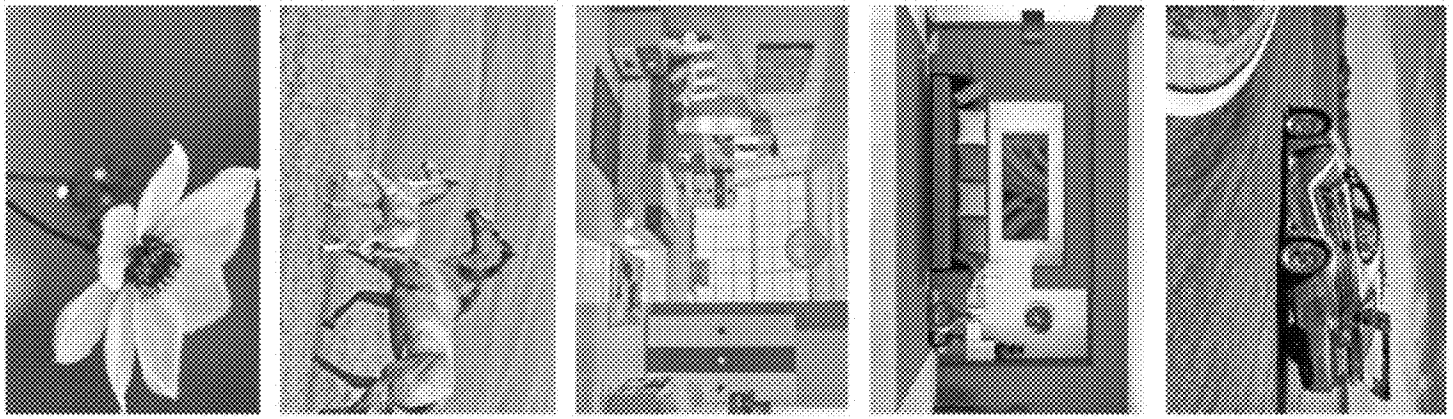
FIG. 9*c* shows the five original images according to the approach of iCAM06 using $L_{src}$=250 cd/m$^2$ and $L_{dest}$=2 cd/m$^2$.
Figure 9D:
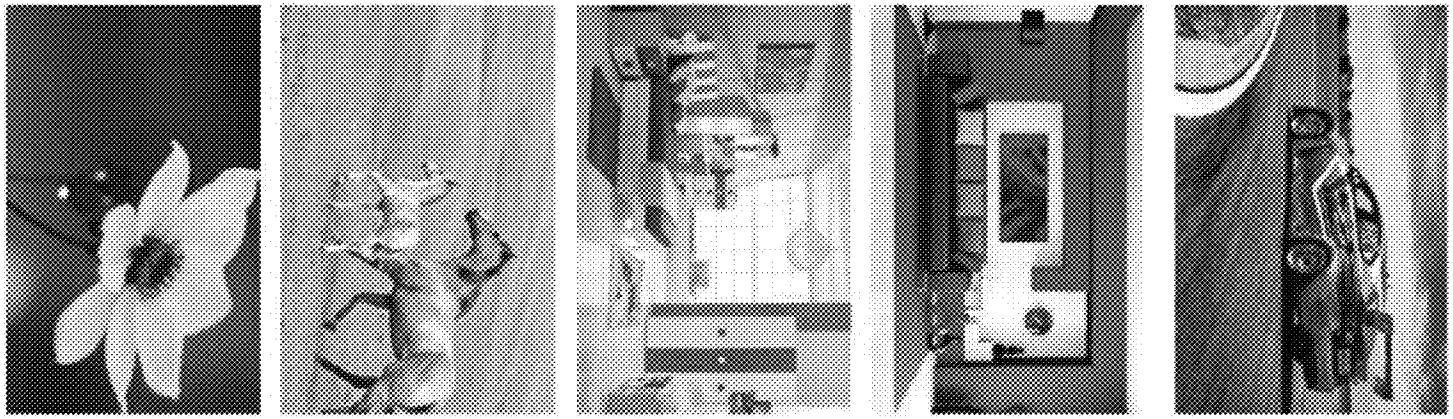
FIG. 9*d* shows a test color retargeting system applying the Shin model for color appearance model and the inverse of the Shin model for color compensation model using $L_{src}$=250 cd/m$^2$ and $L_{dest}$=2 cd/m$^2$.

FIGS. 8*a* and 8*b* displays the $\Delta E_{94}{}^{c}$ and EGR indices of the four images at different display luminance values of 1, 2, 5 and 10 cd/m$^2$. The results of the figures may be summarized as follows: first, the perceptual difference of the compensated image is smaller than that of the unprocessed image for all examined luminance values; second, the $\Delta E_{94}{}^{c}$ measure decreases as the display luminance grows; third, the test system covers a greater portion of the simulated perceived gamut of the original image compared with the unprocessed one; fourth, the dependence of the EGR index has an increasing nature with respect to the display luminance.

Qualitative Evaluation

A subjective experiment is conducted to evaluate the proposed compensation algorithm based on user preference of the color appearance of images shown on a dimmed display. The experiment is carried out on a Samsung Galaxy Tab AMOLED-based Android device. The size of the display is 10.5" with a resolution of 2560 pixels by 1600 pixels. A set of five images is used for the experiment, shown in of FIG. 9.

The images are selected such that they span a range of colors: red, green, blue, yellow, purple, orange and brown. Each image has a simple context and a dominant color in order to minimize the variation of visual attention between different users and facilitate selection of their preferred choice. Eight observers with normal color vision participated in the experiment, from different cultures (Indian, Chinese, Middle East and Western), genders (four females and four males), ages (in the range of 25 to 40 years) and educational background.

Experimental Methods

In the experiment, the following methods are evaluated:

The test color retargeting system is based on the forward and inverse of the Shin mesopic model introduced in this article as a color retargeting approach in FIG. 1.

The Wanat color retargeting approach was proposed by Wanat and Mantiuk. In this algorithm, the Cao algebraic model and its inverse are employed in the retargeting method. This algorithm is implemented and used for processing images as explained in [4].

iCAM06 is one of the most well-known image appearance methods in the literature.[20] The input parameters of this model are set as maximum luminance, $max_L$=2 cd/m$^2$; overall contrast, p=0.7; surround adjustment, $gamma_{value}$=1.

FIGS. 9*a* to 9*d* shows the output of the different models.

Experimental Procedure

Figure 10:
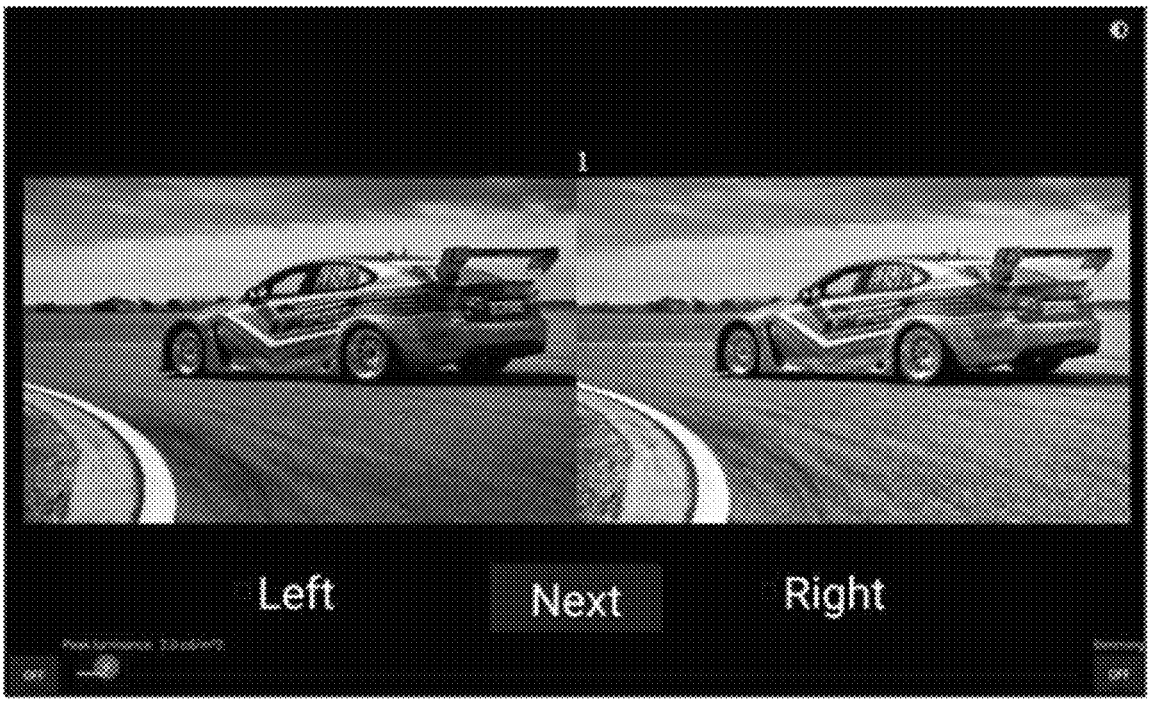
FIG. 10 illustrates the display of a test application for side-by-side comparison of different color retargeting approaches.

A pairwise comparison experiment is carried out in a dark room. An Android application (see FIG. 10) was developed to show two side-by-side images (i.e., a single image that is processed by two different color retargeting approaches) to the user. Each user compares all two method combinations (combinations of picking two out of the four methods) for all five images. The user task is to choose his/her preferred image, displayed on the Samsung tablet, in terms of color appearance at each trial. The display brightness is set to 2 cd/m$^2$. During the experiment, users were able to control their viewing angle and distance from the display.

Discussion of the Experiment Results

Figure 11:
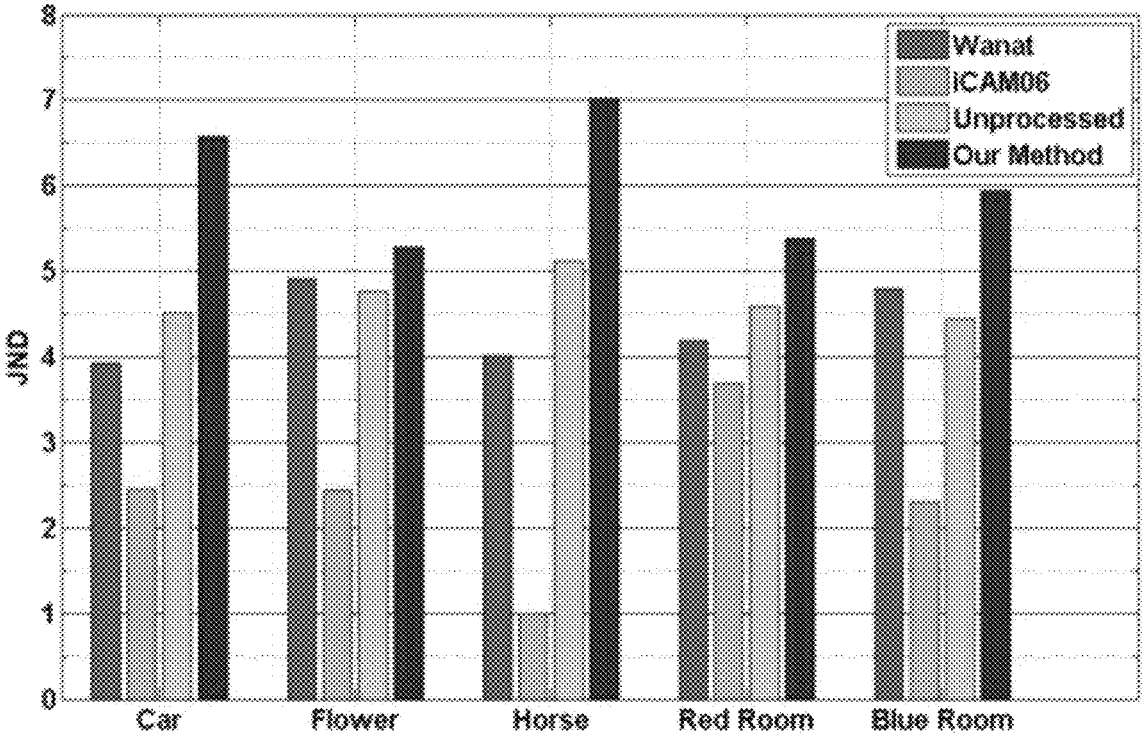
FIG. 11 illustrates results of the pairwise comparison of images of FIGS. 9*a* to 9*d* shown in JND units.

To analyze the results of the pairwise comparison experiment, the scores of each method are transformed to just-noticeable-dierence (JND) units, as defined in [30]. A difference of 1 JND unit represents that one option is selected by 75% of observers over another option. The absolute JND values are not meaningful and only the relative JND difference can be used for discriminating different choices. A method with a higher JND is preferred over methods with smaller JND values. The results of the pairwise comparison experiment scaled in JND units are shown in FIG. 11, and indicate the better performance of the test color retargeting system. The average JND of test color retargeting system over the five images shown in FIG. 9 is 6.04, while the second best method (i.e., unprocessed) has an average JND of 4.69.

The JND score of test color retargeting system is significantly higher than the scores of the other methods over all of the images except the Flower image, for which test color retargeting system is the best but its difference from the Wanat and unprocessed algorithms is not significant. In the Flower image, the three approaches Wanat's, unprocessed and test color retargeting system all have similar performance. This similarity may be due to the dominant yellow color of this image. As explained in. [31], yellow hues appear less saturated than other monochromatic colors. Hence, in dark conditions, yellow is more subject to losing its colorfulness. Moreover, the comparison of perceived gamuts in the quantitative results of FIGS. 4*a* to 7*d* show that the compensated gamut is not extended toward the yellowish region of the chromaticity diagram very much. The observation that in the unprocessed Wanat pair comparison, some users reported difficulty in choosing between the two.

Furthermore, the results show that iCAM06 underperformed compared with the other algorithms because iCAM06 is not designed for compensation purposes and is only able to predict the appearance of the image for an intended luminance.

It was observed the quantitative performance of the methods on different images based on the $\Delta E_{94}^{c}$ and EGR indices with the results of the qualitative experiment. Tables IV and V summarize the quantitative results of the methods for all of the images considered. The two tables show the superiority of the test color retargeting system over the other discussed techniques. Table V shows that the gamut coverage of the test color retargeting system varies over the images, since the performance of the test color retargeting system is content dependent and the images in the database span different chromaticities. It was also observed that the quantitative measures do not completely match the qualitative experiment results, which shows that the quantitative measures still need to be improved. Moreover, it is implied that the $\Delta E_{94}^{c}$ measure has a better correlation with the qualitative results than the EGR index, which is because, in contrast to the EGR, $\Delta E_{94}^{c}$ is a perceptual measure. Sorting the images used in the qualitative evaluation based on Table V and comparing the result with that of the qualitative experiment, it can be inferred that a chromaticity difference of less than one unit is not reliable for judging the color appearance of images.

In the quantitative evaluation, the test color retargeting system is able to roughly reduce the $\Delta E_{94}^{c}$ measure and expand the gamut area of the simulated perceived images by a factor of 2, compared with the unprocessed images. Moreover, the results of the qualitative evaluation demonstrate the potential of the test color retargeting system for improved performance.

Various example embodiments described herein may advantageously be applied to improve user experience when using an electronic device having a display device. More particularly, colors of an image may be retargeted according to systems and methods described herein to improve the appearance of the image when displayed on device. Furthermore, the example methods and systems may be applied to reduce eye strain and improve battery life of the device by providing improved color appearance of the image when displaying the image at low luminance levels. Experiments carried out based on a test color retargeting system applying Shin's color appearance model and an inverse of Shin's color appearance model exhibited improved results over displaying an unprocessed image and existing methods.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

REFERENCES

1. D. Shin, Y. Kim, N. Chang, and M. Pedram, "Dynamic voltage scaling of OLED displays," *Design Automation Conf.* (*DAC*), 2011 48th *ACM/EDAC/IEEE* (IEEE, Piscataway, N.J., 2011), pp. 53-58.
2. K. Blankenbach, A. Sycev, S. Kurbatfinski, and M. Zobl, "Optimizing and evaluating new automotive HMI image enhancement algorithms under bright light conditions using display reflectance characteristics," J. Soc. Inf. Disp. 22, 267_279 (2014).
3. A.-M. Chang, D. Aeschbach, J. F. Duffy, and C. A. Czeisler, "Evening use of light-emitting ereaders negatively affects sleep, circadian timing, and next-morning alertness," Proc. Natl Acad. Sci. USA 112, 1232_1237 (2015).
4. R. Wanat and R. K. Mantiuk, "Simulating and compensating changes in appearance between day and night vision," *Proc. SIGGRAPH*2014 (2014), Vol. 33, p. 147.
5. J. Shin, N. Matsuki, H. Yaguchi, and S. Shioiri, "A color appearance model applicable in mesopic vision," Opt. Rev. 11, 272-278 (2004).
6. B. Masia, G. Wetzstein, P. Didyk, and D. Gutierrez, "A survey on computational displays: pushing the boundaries of optics, computation, and perception," Comput. Graph. 37, 1012-1038 (2013).
7. J. A. Ferwerda, S. N. Pattanaik, P. Shirley, and D. P. Greenberg, "A model of visual adaptation for realistic image synthesis," *Proc. 23rd Annual Conf. on Computer Graphics and Interactive Techniques* (ACM, 1996), pp. 249-258.
8. M. F. Deering, "A photon accurate model of the human eye," *ACM Transactions on Graphics* (TOG) (ACM, 2005), Vol. 24, pp. 649-658.
9. M. H. Kim, T. Weyrich, and J. Kautz, "Modeling human color perception under extended luminance levels," *ACM Transactions on Graphics* (TOG) (ACM, 2009), Vol. 28, p. 27.
10. S. M. Khan and S. N. Pattanaik, "Modeling blue shift in moonlit scenes by rod cone interaction," J. Vis. 4, 316a (2004).
11. M. Rezagholizadeh and J. J. Clark, "Photon detection and color perception at low light levels," *Computer and Robot Vision* (*CRV*), 2014 *Canadian Conf.* (IEEE, Piscataway, N.J., 2014), pp. 283-290.
12. W. B. Thompson, P. Shirley, and J. A. Ferwerda, "A spatial post-processing algorithm for images of night scenes," J. Graph. Tools 7, 1-12 (2002).
13. P. Kellnhofer, T. Ritschel, K. Myszkowski, E. Eisemann, and H.-P. Seidel, "Modeling luminance perception at absolute threshold," *Computer Graphics Forum* (Wiley Online Library, 2015), Vol. 34, pp. 155-164.
14. M. D. Fairchild, "A revision of ciecam97s for practical applications," Color Res. Appl. 26, 418-427 (2001).
15. N. Moroney, M. D. Fairchild, R. W. Hunt, C. Li, M. R. Luo, and T. Newman, "The ciecam02 color appearance model," *IS&T/SID Proc. CIC*10*: Tenth Color Imaging Conf.* (IS&T, Springfield, VA, 2002), pp. 23-27.
16. B. A. Wandell and E. Chichilnisky, "Color appearance in images measurements and musings," *IS&T/SID Proc. CIC*2 *Color Imaging Conf.* (IS&T, Springfield, VA, 1994), pp. 1-4.
17. M. D. Fairchild and G. M. Johnson, "Image appearance modeling," Proc. SPIE 5007, 149-160 (2003).
18. Y. Kwak, L. W. MacDonald, and M. R. Luo, "Mesopic color appearance," Proc. SPIE 5007, 161-169 (2003).
19. M. D. Fairchild and G. M. Johnson, "Meet icam: a next-generation color appearance model," *IS&T/SID Proc. CIC*10*: Tenth Color Imaging Conf.* (IS&T, Springfield, VA, 2002), pp. 33-38.

20 J. Kuang, G. M. Johnson, and M. D. Fairchild, "icam06: a refined image appearance model for HDR image rendering," J. Vis. Commun. Image Represent. 18, 406-414 (2007).

21 D. Cao, J. Pokorny, V. C. Smith, and A. J. Zele, "Rod contributions to color perception: linear with rod contrast," Vis. Res. 48, 2586-2592 (2008).

22 J. J. McCann, "Color gamuts in dim illumination," Proc. *SPIE* 6807, 680703 (2008).

23 M. Rezagholizadeh and J. J. Clark, "Maximum entropy spectral modeling approach to mesopic tone mapping," *IS&T's Proc. CIC*21*: Twenty-first Color and Imaging Conf.* (IS&T, Springfield, VA, 2013), pp. 154-159.

24 R. Hunt, "An improved predictor of colourfulness in a model of colour vision," Color Res. Appl. 19, 23-26 (1994).

25 Y. Kwak, L. W. MacDonald, and M. R. Luo, "Prediction of lightness in mesopic vision," *IS&T/SID Proc. CIC*11*: Eleventh Color Imaging Conf.* (IS&T, Springfield, VA, 2003), pp. 301-307.

26 A. G. Kirk and J. F. O'Brien, "Perceptually based tone mapping for low-light conditions," ACM Trans. Graph. 30, 42 (2011).

27 R. Wanat and R. K. Mantiuk, "A comparison of night vision simulation methods for video," *Proc.* 11*th European Conf. on Visual Media Production* (ACM, 2014), p. 16.

28 G. Ward, "High dynamic range imaging," *IS&T/SID Proc. CIC*9*: Ninth Color Imaging Conf.* (IS&T, Springfield, VA, 2001), pp. 9_16.

29 M. D. Fairchild, *Color appearance models* (John Wiley & Sons, 2013).

30 G. Eilertsen, R. Wanat, R. K. Mantiuk, and J. Unger, "Evaluation of tone mapping operators for HDR-video," Computer Graphics Forum (Wiley Online Library, 2013), Vol. 32, pp. 275-284.

31 J. J. Clark and S. Skaff, "A spectral theory of color perception," J. Opt. Soc. Am. A 26, 2488_2502 (2009).

32. Laine, J. S. (2003). Adapting softcopy color reproduction to ambient illumination. *Journal of SID,* 11(2), 359.

The invention claimed is:

1. A computer-implemented color system for color retargeting of an image, the system comprising:

at least one data storage device; and at least one processor coupled to the at least one storage device, the at least one processor being configured for:

applying a color appearance model to the image to be displayed based in part on a first luminance level, the color appearance model outputting a first set of color responses representing a simulated version of the image at the first luminance level; and applying a color compensation model to the first set of color responses based in part on a second luminance level, the color compensation model outputting a second set of color responses representing a compensated version of the image, at least one of the color appearance model and the color compensation model applying rod-intrusion correction.

2. The system of claim 1, wherein the color compensation model corresponds to an inverse of the color appearance model and wherein the color appearance model applies an estimate of rod intrusion.

3. The system of claim 1, wherein the simulated version of the image represented by the first set of color responses outputted by the color appearance model corresponds to a simulation of the image as perceived by a human at the first luminance level; and wherein the compensated version of the image represented by the second set of color responses outputted by the color compensation model corresponds to a compensated image that when displayed at the second luminance level would be perceived by a human as having the first set of color responses.

4. The system of claim 1, wherein the compensated version of the image represented by the second set of color responses outputted by the color compensation model corresponds to a compensated image that when displayed at the second luminance level would be perceived by a human as having a color appearance closer to the first set of color responses than the inputted image being displayed at the second luminance level without applying the color appearance model and the color compensation model.

5. The system of claim 1, wherein the first set of color responses is representative of cone and rod-based human vision;

wherein the first set of color responses is a set of opponent responses;

wherein the second set of color responses is representative of cone and rod-based human vision; and wherein the second set of color responses is represented in LMS space.

6. The system of claim 1, wherein the processor is further configured for:

transforming the second set of color responses to a color space suitable for display on an electronic display device; and displaying the compensated version of the image on an electronic display device; and wherein the electronic display device is set to emit an average luminance corresponding to the second luminance level while displaying the compensated version of the image.

7. The system of claim 1, wherein applying the color appearance model with rod-intrusion correction comprises applying a first set of rod-weighting coefficients determined based on the first luminance level; and wherein applying the color compensation model with rod-intrusion correction comprises applying a second a second set of rod-weighting coefficients determined based on the second luminance level.

8. The system of claim 1, wherein the first luminance level is substantially greater than the second luminance level; and wherein the first luminance level is greater than 10 cd/m$^2$.

9. The system of claim 1, wherein the color appearance model with rod intrusion correction is Shin's color appearance model;

wherein the color compensation model with rod-intrusion correction is an inverse of Shin's color appearance model.

10. The system of claim 9, wherein the first set of color responses outputted by Shin's color appearance model is a set of opponent responses;

wherein the set of opponent responses is inputted to the color compensation model with rod-intrusion correction; and wherein the second set of color responses is represented in LMS space and is determined according to:

$$\overline{L_p} + \overline{M_p} = ((L_{pw} + M_{pw}) / \alpha(\overline{E}) K_w) \times (A(E) - \beta(\overline{E}) K'_w (Y' / Y'_w)^{\gamma})$$

$$\overline{L_p} - 2\overline{M_p} = \frac{(r / g(E) - a(\overline{E}) \times Y')}{l(\overline{E})}$$

-continued $$\overline{L_p} + \overline{M_p} - \overline{S_p} = \frac{(b/y(E) - b(\overline{E}) \times Y')}{m(\overline{E})}.$$

11. The system of claim 1, wherein applying rod-intrusion comprises accounting for use of rods in human vision.

12. The system of claim 1, wherein the color appearance model characterizes perceptual attributes of human vision of the image displayed at the first luminance level; and wherein the color compensation model characterizes perceptual attributes of human vision of the compensated version of the image displayed at the second luminance level.

13. A method for color retargeting of an image, the method comprising applying a color appearance model to the image to be displayed based in part on a first luminance level, the color appearance model outputting a first set of color responses representing a simulated version of the image at the first luminance level; and applying a color compensation model to the first set of color responses based in part on a second luminance level, the color compensation model outputting a second set of color responses representing a compensated version of the image, at least one of the color appearance model and the color compensation model applying rod-intrusion correction.

14. The method of claim 13, wherein the color compensation model corresponds to an inverse of the color appearance model and wherein the color appearance model applies an estimate of rod intrusion.

15. The method of claim 13, wherein the simulated version of the image represented by the first set of color responses outputted by the color appearance model corresponds to a simulation of the image as perceived by a human at the first luminance level; and wherein the compensated version of the image represented by the second set of color responses outputted by the color compensation model corresponds to a compensated image that when displayed at the second luminance level would be perceived by a human as having the first set of color responses.

16. The method of claim 13, wherein the compensated version of the image represented by the second set of color responses outputted by the color compensation model corresponds to a compensated image that when displayed at the second luminance level would be perceived by a human as having a color appearance closer to the first set of color responses than the inputted image being displayed at the second luminance level without applying the color appearance model and the color compensation model.

17. The method of claim 13, wherein the first set of color responses is representative of cone and rod-based human vision;

wherein the first set of color responses is a set of opponent responses;

wherein the second set of color responses is representative of cone and rod-based human vision;

wherein the second set of color responses is represented in LMS space.

18. The method of claim 13, further comprising:

transforming the second set of color responses to a color space suitable for display on an electronic display device; and displaying the compensated version of the image on an electronic display device; and wherein the electronic display device is set to emit an average luminance corresponding to the second luminance level while displaying the compensated version of the image.

19. The method of claim 13, wherein applying the color appearance model with rod-intrusion correction comprises applying a first set of rod-weighting coefficients determined based on the first luminance level; and wherein applying the color compensation model with rod-intrusion correction comprises applying a second a second set of rod-weighting coefficients determined based on the second luminance level.

20. The method of claim 13, wherein the first luminance level is substantially greater than the second luminance level; and wherein the first luminance level is greater than 10 cd/m$^2$.

21. The method of claim 13, wherein the color appearance model with rod intrusion correction is Shin's color appearance model;

wherein the color compensation model with rod-intrusion correction is an inverse of Shin's color appearance model.

22. The method of claim 21, wherein the first set of color responses outputted by Shin's color appearance model is a set of opponent responses; and wherein the set of opponent responses is inputted to the color compensation model with rod-intrusion correction; and wherein the second set of color responses is represented in LMS space and is determined according to:

$$\overline{L_p} + \overline{M_p} = ((L_{pw} + M_{pw})/\alpha(\overline{E})K_w) \times (A(E) - \beta(\overline{E})K'_w(Y'/Y'_w)^{\gamma})$$

$$\overline{L_p} - 2\overline{M_p} = \frac{\left(\frac{r}{g(\overline{E})} - a(\overline{E}) \times Y'\right)}{l(\overline{E})}$$

$$\overline{L_p} + \overline{M_p} - \overline{S_p} = \frac{(b/y(E) - b(\overline{E}) \times Y')}{m(\overline{E})}.$$

23. The method of claim 13, wherein applying rod-intrusion comprises accounting for use of rods in human vision.

24. The method of claim 13, wherein the color appearance model characterizes perceptual attributes of human vision of the image displayed at the first luminance level; and wherein the color compensation model characterizes perceptual attributes of human vision of the compensated version of the image displayed at the second luminance level.

25. A method of processing images, the method comprising:

obtaining an image;

applying Shin's model to the image to generate a set of luminance dependent parameters based at least in part on scene luminance associated with the image;

applying an inverse of Shin's model to the luminance dependent parameters to approximate white point LMS values based at least in part on display luminance associated with a display onto which the image is to be shown;

transforming the LMS values to generate a target image; and outputting the target image for display.

26. The method of claim 25, wherein the inverse of Shin's model is generated by:

calculating the luminance dependent parameters of the display;

approximating the white point LMS values and scotopic luminance value of a backward model;

calculating LMS excitation values;

transforming the LMS excitation values to obtain the LMS values; and applying a linear transform to convert the LMS values to XYZ values and RGB values.

27. The method of claim 26, wherein the white point LMS values are approximated by:

$$\overline{LMS_w} = [\,\overline{L_w}\quad \overline{M_w}\quad \overline{S_w}\,]^t = \frac{\overline{E}}{E}[\,L_{pw}\quad M_{pw}\quad S_{pw}\,]^t$$

$$\overline{Y'} = \frac{\overline{E}}{E} \times Y';$$

wherein the LMS excitation values are obtained using:

$$\overline{L_p} + \overline{M_p} = ((L_{pw} + M_{pw})/\alpha(\overline{E})K_w) \times \left(A(E) - \beta(\overline{E})K'_w\left(\overline{Y'}/\overline{Y'_w}\right)^{\gamma}\right)$$

-continued $$\overline{L_p} - 2\overline{M_p} = \frac{\left(r/g(E) - a(\overline{E}) \times \overline{Y'}\right)}{l(\overline{E})}$$

$$\overline{L_p} + \overline{M_p} - \overline{S_p} = \frac{\left(b/y(E) - b(\overline{E}) \times \overline{Y'}\right)}{m(\overline{E})};$$

and wherein the LMS excitation values are transformed to obtain the LMS values using the following linear transformation:

$$\begin{bmatrix} \overline{L_p} \\ \overline{M_p} \\ \overline{S_p} \end{bmatrix} = \begin{bmatrix} 1 & 1 & 0 \\ 1 & -2 & 0 \\ 1 & 1 & -1 \end{bmatrix}^{-1} \begin{bmatrix} \overline{L_p} + \overline{M_p} \\ \overline{L_p} - 2\overline{M_p} \\ \overline{L_p} + \overline{M_p} - \overline{S_p} \end{bmatrix}.$$

28. The method of claim 25, wherein the target image compensates for color deviations impose by the human visual system for perceptual rendering of dark images.

* * * * *